US012193548B2

(12) United States Patent
Dalton

(10) Patent No.: US 12,193,548 B2
(45) Date of Patent: Jan. 14, 2025

(54) ARTICULATED LIGHT TRANSMITTING TRANSPARENT COVER APPARATUS

(71) Applicant: James Dalton, Lakewood, CO (US)

(72) Inventor: James Dalton, Lakewood, CO (US)

( * ) Notice: Subject to any disclaimer, the term of this patent is extended or adjusted under 35 U.S.C. 154(b) by 205 days.

(21) Appl. No.: 17/842,710

(22) Filed: Jun. 16, 2022

(65) Prior Publication Data

US 2022/0312917 A1 Oct. 6, 2022

Related U.S. Application Data

(63) Continuation-in-part of application No. 29/744,683, filed on Jul. 30, 2020, now Pat. No. Des. 958,796.

(51) Int. Cl.
*A45C 11/00* (2006.01)
*A45C 13/00* (2006.01)

(52) U.S. Cl.
CPC ..... *A45C 11/00* (2013.01); *A45C 13/005* (2013.01); *A45C 2011/002* (2013.01); *A45C 2011/003* (2013.01)

(58) Field of Classification Search
CPC ..... A45C 2011/003; A45C 2011/002; A45C 13/005; A45C 13/00; A45C 11/00
USPC ..... 206/320, 45.23
See application file for complete search history.

(56) References Cited

U.S. PATENT DOCUMENTS

| | | | | |
|---|---|---|---|---|
| 8,763,795 | B1 * | 7/2014 | Oten | B65D 85/00 206/45.24 |
| 8,887,910 | B2 * | 11/2014 | Ashley | A45C 11/24 206/45.24 |
| 8,929,068 | B2 * | 1/2015 | Richardson | B65D 81/02 361/679.55 |
| 2006/0081489 | A1 * | 4/2006 | Wheeler | G06F 1/1628 206/320 |
| 2012/0043247 | A1 * | 2/2012 | Westrup | G06F 1/1633 206/472 |
| 2015/0351508 | A1 * | 12/2015 | Buijssen | A45C 11/00 224/191 |
| 2018/0188777 | A1 * | 7/2018 | Douros, Sr. | G06F 1/1626 |
| 2019/0159561 | A1 * | 5/2019 | Kim | E05D 11/08 |
| 2020/0037716 | A1 * | 2/2020 | Lim | H04B 1/3888 |
| 2021/0208721 | A1 * | 7/2021 | Lee | A45C 11/00 |

* cited by examiner

*Primary Examiner* — Steven A. Reynolds
(74) *Attorney, Agent, or Firm* — Roger A. Jackson

(57) ABSTRACT

Broadly, the present invention is of an articulated light transmitting cover apparatus adapted to attach to an article with a display, the cover apparatus including a light transmitting planar cover that is adapted to be removably adjacent to the article display, the light transmitting cover having a cover lengthwise axis and a perpendicularly positioned cover crosswise axis, further the light transmitting cover has a cover primary margin and an opposing cover secondary margin with the cover lengthwise axis spanning therebetween, in addition the light transmitting cover has a cover initial end portion and an opposing cover subsequent end portion with the cover crosswise axis spanning therebetween.

7 Claims, 21 Drawing Sheets

ARTICULATED LIGHT TRANSMITTING TRANSPARENT COVER APPARATUS

RELATED APPLICATIONS

This application is a continuation in part of United States design patent application Ser. No. 29/744,683 filed on Jul. 30, 2020 by James Dalton of Lakewood, Colorado, U.S.

TECHNICAL FIELD

The present invention generally relates to a portable light transmitting apparatus used typically to selectably filter light from an article display. More particularly, the present invention is a light transmitting portable removably engageable planar cover that is adapted to be adjacent to the display of an article.

BACKGROUND OF INVENTION

The predominance of portable articles with displays, such as smart phones, tablets, E-readers, and laptops has resulted in them becoming a staple of individual's in their everyday life, with hours of screen time daily becoming a normal occurrence. Because of this extraordinary amount of screen time becoming common, the subtle effects of screen filtering, glare, etc., are becoming significant for the user's eye strain comfort in viewing the screen or display. Thus, having a compact, portable, and easy to use screen display light filter would be highly desirable, especially in the area of applying and removing the screen display light filter to the display. The display light filter or as termed a light transmitting transparent cover could lay on the article display or be attached via an articulated hinge.

Looking at the prior art in United States Patent Application Publication Number 2017/0235243 to Cho et al., disclosed is a hinge device using a plurality of hinge blocks designed specifically to protect flexible electronic displays from damage as the hinge blocks shrink or elongate during bending to shelter the electronic flexible display from the shrinkage or elongation, thus only allowing the flexible display to be bent in a straight line to help stay within the electronic flexible display flex deflection limits to avoid damage to the display.

Continuing in the prior art in U.S. Pat. No. 10,194,723 to Skepton, disclosed is an electronic device cover kit that allows for print personalization through multiple layer sheets of which some accept ink, wherein the complete cover assembly has a laminate type sealed print personalization disposed within the cover.

Next in the prior art in U.S. Pat. No. 9,946,312 to McCracken et al., disclosed in an articulated screen cover for an electronic device, the screen cover has a multi-segmented hinge that folds around the electronic device via having rigid material sections disposed in-between the hinge segments, essentially creating a pivotal hinge that can accommodate folding around a thicker article.

Further, in the prior art in U.S. Pat. No. 9,013,867 to Becze et al., disclosed is a hinge for a hand held computing device including a first screen with a first display and a second screen with a second display with a hinge disposed between the first and second displays, wherein the hinge has a plurality of axes to facilitate rotations about multiple axes, further the hinge can include an electrical communication hub to allow electronic data transfer between the screens.

Moving onward in the prior art in U.S. Pat. No. 8,971,029 to Wong et al., disclosed is a multi display hinge assembly that includes offset hinges that facilitate the display thickness while at the same time allowing the hinge to fully open and to fully close, this is to allow for more screen viewing positional options for the user, so that for instance one screen may be for data and another screen for commands.

There remains a need for having a compact, portable, and easy to use screen display light filter would be highly desirable, especially in the area of applying and removing the screen display light filter from the electronic display. The display light filter or as termed a light transmitting transparent cover could lay on the article display or be attached via an articulated hinge.

SUMMARY OF INVENTION

Broadly, the present invention is of an articulated light transmitting transparent cover apparatus adapted to attach to an article with a display, the cover apparatus including a light transmitting transparent cover that is adapted to be removably adjacent to the article display, the light transmitting cover having a cover lengthwise axis and a perpendicularly positioned cover crosswise axis, further the light transmitting transparent cover has a transparent cover primary margin and an opposing transparent cover secondary margin with the transparent cover lengthwise axis spanning therebetween, in addition the light transmitting transparent cover has a transparent cover initial end portion and an opposing transparent cover subsequent end portion with the transparent cover crosswise axis spanning therebetween.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 16 is view 16-16 from FIG. 11, wherein FIG. 16 shows the removably engageable clip being retained therethrough in the surrounding sidewall adjacent to the second flexible hinge with the clip having an expanded portion disposed on an opposing side of the surrounding sidewall to help retain the clip as against the article outer periphery, thus helping to hold the article within the holder with the article being nested against the surrounding sidewall and base all of the holder for the articulated light transmitting transparent cover apparatus, note that the clip could be disposed on the opposite side of the surrounding sidewall adjacent to both the first and second flexible hinges for the second alternate embodiment of the articulated light transmitting transparent cover apparatus as shown in FIG. 19;

FIG. 21 is view 21-21 from FIG. 17, wherein FIG. 21 shows the portfolio style of the first and second flexible hinges of the second alternate embodiment of the articulated light transmitting transparent cover apparatus, wherein the holder surrounding sidewall and base are attached to both the first and second flexible hinges at respectively at the first and second portions of the surrounding sidewall and base, with the first flexible hinge supporting the opaque cover proximal margin and the second flexible hinge supporting the light transmitting transparent cover proximal margin, wherein the first and second flexible hinges are nested to one another as FIG. 21 shows.

REFERENCE NUMBERS IN DRAWINGS

Figure 1:
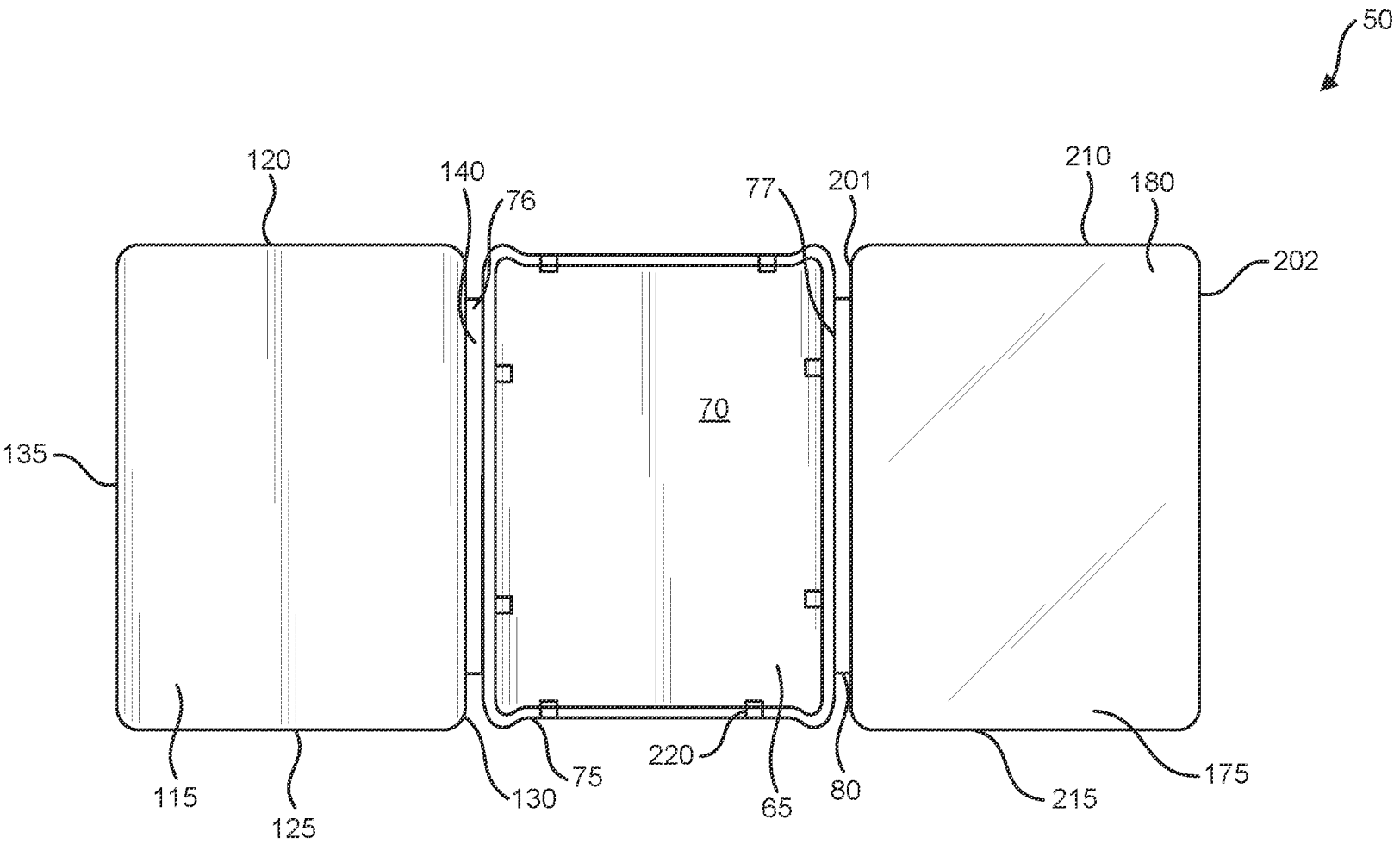
FIG. 1 is a flat plan top view of the articulated light transmitting transparent cover apparatus fully opened showing from left to right, an opaque cover that has a first flexible hinge that is disposed between a proximal margin of the opaque cover and a first portion of a surrounding sidewall extending from a base of a holder that is adapted to hold an article, further continuing from left to right a second flexible hinge is disposed between a second portion of the surrounding sidewall and a proximal margin of a transparent cover, all shown in an open state of use.

50 Articulated light transmitting transparent cover apparatus
51 Second alternate embodiment of the articulated light transmitting transparent cover apparatus
55 Article having an article outer periphery 56
56 Outer periphery of the article 55
60 Display of the article 55
61 Screen text of the display 60
65 Holder for article adapted to hold the article 55 periphery 56
70 Base for holder 65
75 Surrounding sidewall for the holder 65
76 First portion of the surrounding sidewall 75 and base 70
77 Second portion of the surrounding sidewall 75 and base 70
80 Second flexible hinge disposed between the transparent cover 175 proximal margin
201 and the and the second portion 77 of the surrounding sidewall 75 and base 70
85 Connector structure portion adjacent to the base 70 disposed opposite of the surrounding sidewall 75 and disposed between the first flexible hinge 140 and the second flexible hinge 80
115 Opaque cover
120 Initial end portion of the opaque cover 115
125 Subsequent end portions of the opaque cover 115
130 Proximal margin the opaque cover 115
135 Distal margin the opaque cover 115
140 First flexible hinge disposed between the opaque cover 115 proximal margin 130 and the and the first portion 76 of the surrounding sidewall 75 and base 70
175 Light transmitting transparent cover
180 Removably adjacent interface of the light transmitting planar cover 175 to the article 55
185 Lengthwise axis of the transparent cover 175
190 Crosswise axis of the transparent cover 175
195 Perpendicular position of the transparent cover 175 lengthwise axis 185 and the transparent cover 175 crosswise axis 190
200 Primary margin of the transparent cover 175
201 Proximal margin of the transparent cover 175
202 Distal margin of the transparent cover 175
205 Secondary margin of the transparent cover 175
210 Initial end portion of the transparent cover 175
215 Subsequent end portion of the transparent cover 175
220 Removably engageable flexible clip that retains the article 55 outer periphery 56 to the surrounding sidewall 75 and base 70 of the holder 65
225 Expanded portion of the clip 220 that retains the clip 220 to the surrounding sidewall 75 and base 70 of the holder 65
260 Helping keep adjacent position of the light transmitting planar cover 175 to the display 60
265 Removing away motion of the light transmitting planar cover 175 from the display 60
275 Semi-rigid border of the transparent cover 175
280 Forming a perimeter around the light transmitting planar cover 175 of the semi-rigid border 275
285 Grab edge of the semi-rigid border 275
400 First alternate embodiment of the articulated light transmitting transparent cover apparatus

DETAILED DESCRIPTION

With initial reference to FIG. 1 shown is the flat plan top view of the articulated light transmitting transparent cover apparatus 50 fully opened showing from left to right, the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing from left to right, the second flexible hinge 80 is disposed between a second portion 77 of the surrounding sidewall 75 and the proximal margin 201 of the transparent cover 175, all shown in an open state of use. Wherein, FIG. 1 shows the opaque cover 115 and the transparent cover 175 both in the fold flat open state operationally.

Figure 2:
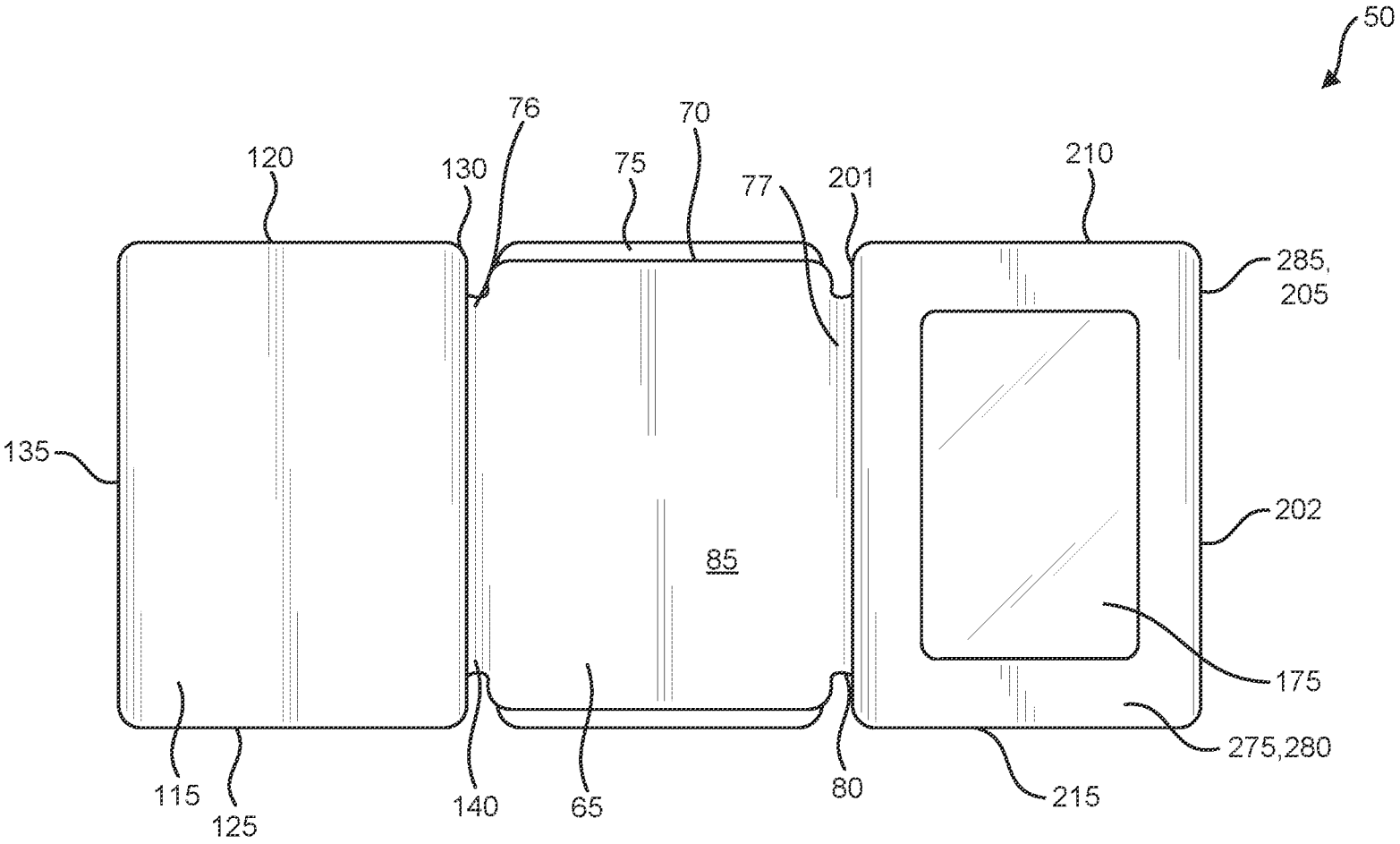
FIG. 2 is a flat plan bottom view of the articulated light transmitting transparent cover apparatus fully opened showing from left to right, the opaque cover that has the first flexible hinge that is disposed between the proximal margin of the opaque cover and the first portion of the surrounding sidewall extending from the base of the holder that is adapted to hold the article, further continuing from left to right a connector portion that is adjacent to the base continuing onto the second flexible hinge that is disposed between the second portion of the surrounding sidewall and the proximal margin of the transparent cover that includes a semi-rigid border that forms a perimeter around the transparent cover, all shown in the open state of use.

Next, FIG. 2 is a flat plan bottom view of the articulated light transmitting transparent cover apparatus 50 fully opened showing from left to right, the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing from left to right, the connector portion 85 that is adjacent to the base 70 continuing onto the second flexible hinge 80 that is disposed between the second portion 77 of the surrounding sidewall 75 and the proximal margin 201 of the transparent cover 175 that includes a semirigid border 275 that forms the perimeter 280 around the transparent cover 175, all shown in the open state of use. Wherein, FIG. 2 shows the opaque cover 115 and the transparent cover 175 both in the fold flat open state operationally.

Figure 3:
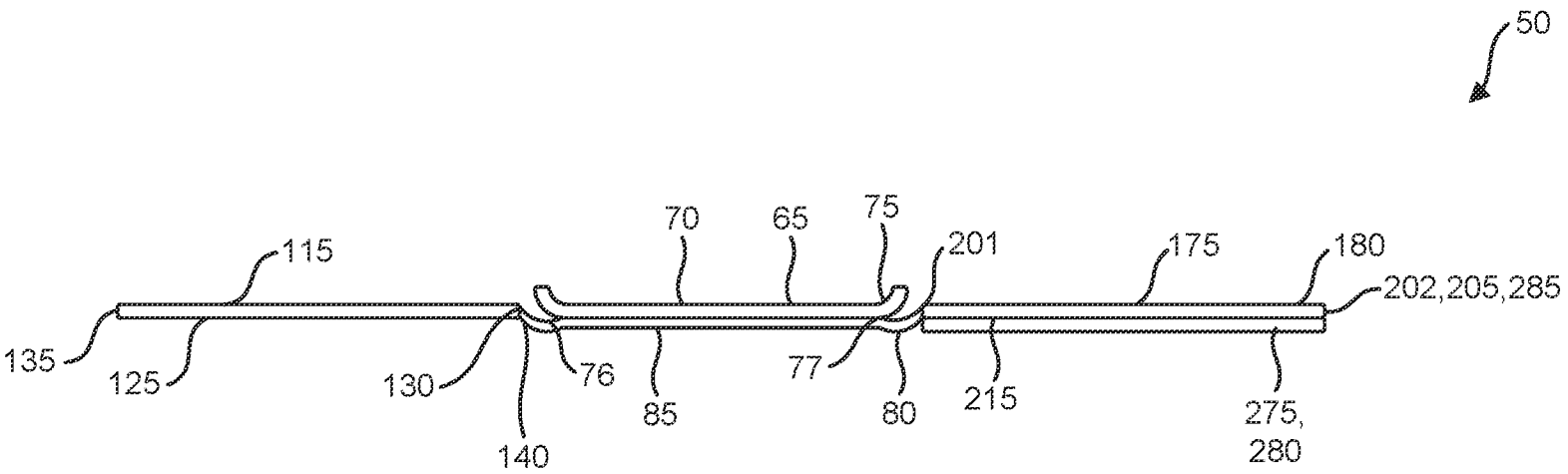
FIG. 3 is a side elevation view of the articulated light transmitting transparent cover apparatus fully opened showing from left to right, the opaque cover that has the first flexible hinge that is disposed between the proximal margin of the opaque cover and the first portion of the surrounding sidewall extending from the base of the holder that is adapted to hold the article, further continuing from left to right, a connector portion that is adjacent to the base continuing onto the second flexible hinge that is disposed between the second portion of the surrounding sidewall and the proximal margin of the transparent cover that includes a side elevation view of the semirigid border that forms a perimeter around the transparent cover, all shown in the open state of use.

Further, FIG. 3 is a side elevation view of the articulated light transmitting transparent cover apparatus 50 fully opened showing from left to right, the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing from left to right, a connector portion 85 that is adjacent to the base 70 continuing onto the second flexible hinge 80 that is disposed between the second portion 77 of the surrounding sidewall 75 and the proximal margin 201 of the transparent cover 175 that includes a side elevation view of the semirigid border 275 that forms the perimeter 280 around the transparent cover 175, all shown in the open state of use. Wherein, FIG. 3 shows the opaque cover 115 and the transparent cover 175 both in the fold flat open state operationally.

Figure 4:
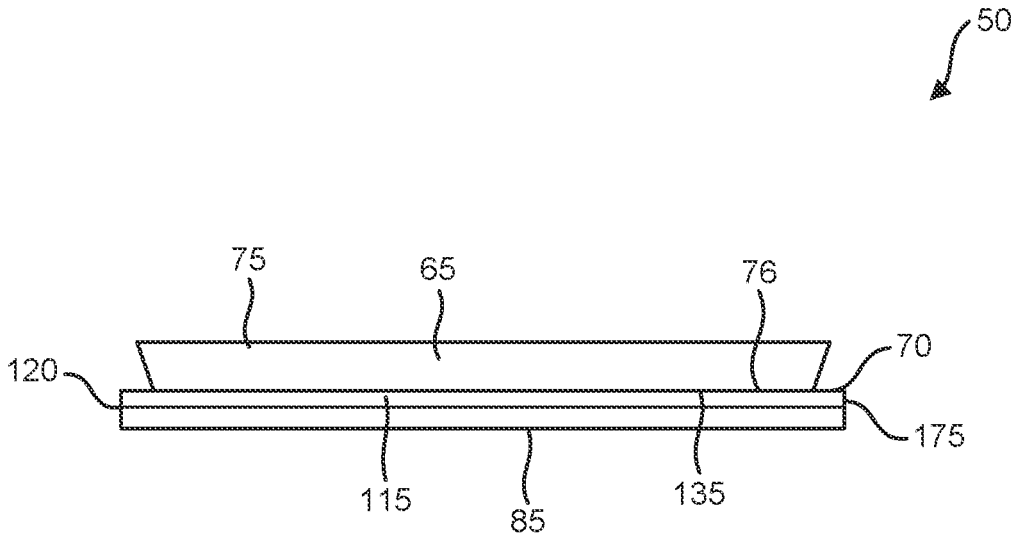
FIG. 4 is an end elevation view of the articulated light transmitting transparent cover apparatus fully opened that shows the opaque cover with initial and subsequent end portions plus the holder with base and surrounding sidewall with the articulated light transmitting cover apparatus shown in the open state of use.

Continuing, FIG. 4 is an end elevation view of the articulated light transmitting transparent cover apparatus 50 fully opened that shows the opaque cover 115 with initial 120 and subsequent 125 end portions plus the holder 65 with base 70 and surrounding sidewall 75 with the articulated light transmitting cover apparatus 50 shown in the open state of use. Wherein, FIG. 4 shows the opaque cover 115 and the transparent cover 175 both in the fold flat open state operationally.

Figure 5:
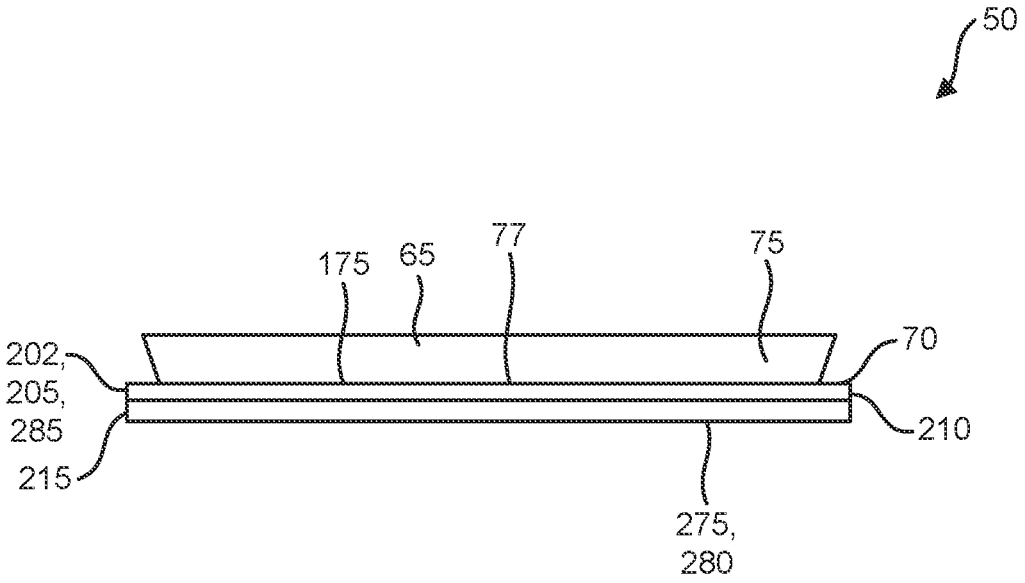
FIG. 5 is an opposing end elevation view of the articulated light transmitting transparent cover apparatus fully opened that shows the light transmitting transparent cover with initial and subsequent end portions plus the holder with base and surrounding sidewall with the articulated light transmitting cover apparatus shown in the open state of use.

Moving inward, FIG. 5 is an opposing end elevation view of the articulated light transmitting transparent cover apparatus 50 fully opened that shows the light transmitting transparent cover 175 with initial 210 and subsequent 215 end portions plus the holder 65 with base 70 and surrounding sidewall 75 with the articulated light transmitting cover apparatus 50 shown in the open state of use. Wherein, FIG. 5 shows the opaque cover 115 and the transparent cover 175 both in the fold flat open state operationally.

Figure 6:
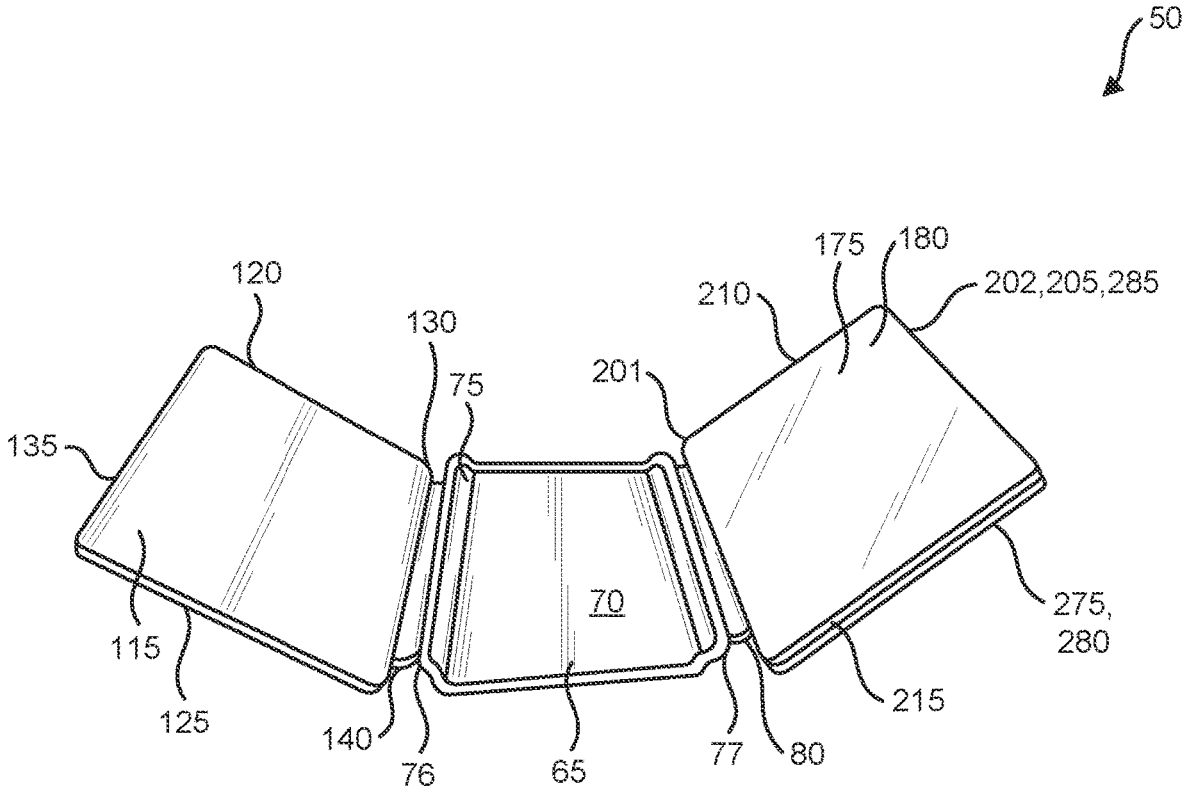
FIG. 6 is an upper perspective view of the articulated light transmitting transparent cover apparatus fully opened showing from left to right the opaque cover that has the first flexible hinge that is disposed between the proximal margin of the opaque cover and the first portion of the surrounding sidewall extending from the base of the holder that is adapted to hold the article, further continuing from left to right the second flexible hinge is disposed between the second portion of the surrounding sidewall and the proximal margin of the transparent cover, all shown in the open state of use.

Further, FIG. 6 is an upper perspective view of the articulated light transmitting transparent cover apparatus 50 fully opened showing from left to right the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing from left to right the second flexible hinge 80 is disposed between the second portion 77 of the surrounding sidewall 75 and the proximal margin 201 of the transparent cover 175, all shown in the open state of use.

Figure 7:
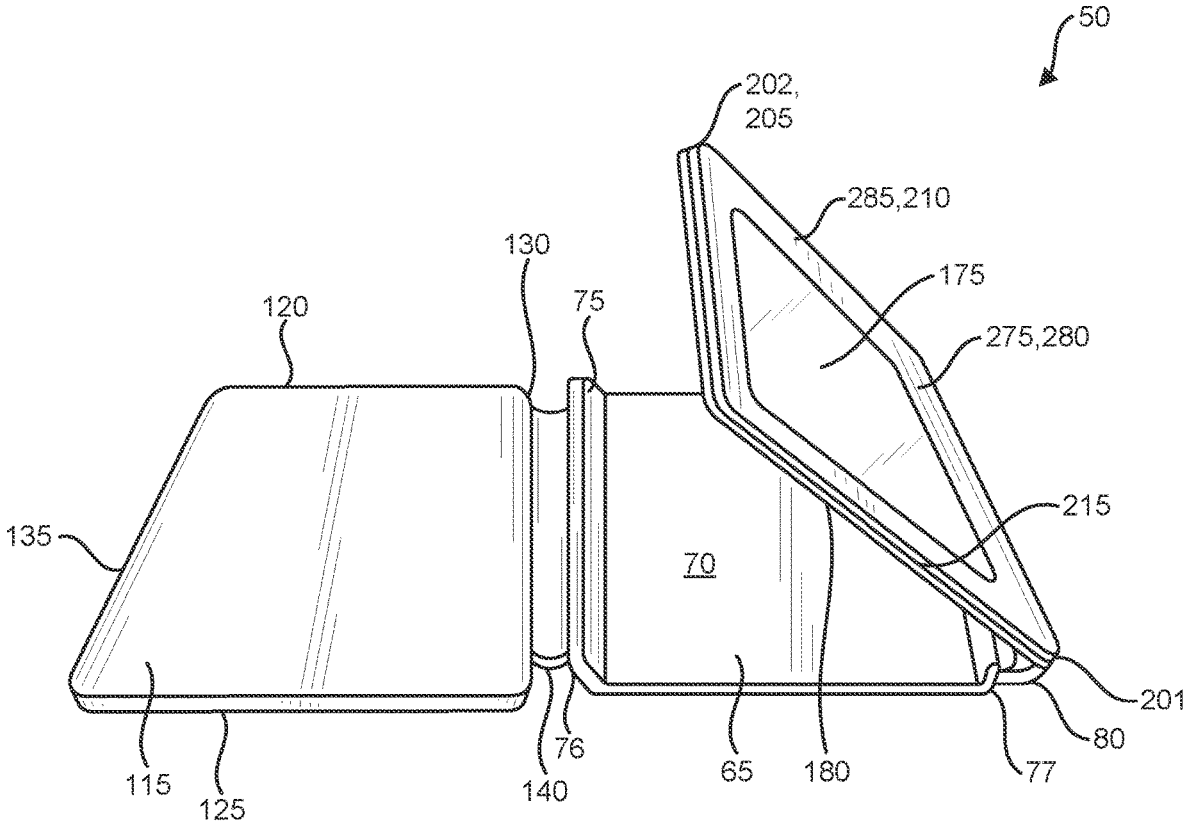
FIG. 7 is an upper perspective view of the articulated light transmitting transparent cover apparatus partially opened showing from left to right, the opaque cover that has the first flexible hinge that is disposed between the proximal margin of the opaque cover and the first portion of the surrounding sidewall extending from the base of the holder that is adapted to hold the article, further continuing from left to right, the second flexible hinge is disposed between the second portion of the surrounding sidewall and the proximal margin of the transparent cover, all shown in the partially open state of use with the light transmitting transparent cover folded over the holder for the article.

Next, FIG. 7 is an upper perspective view of the articulated light transmitting transparent cover apparatus 50 partially opened showing from left to right the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing from left to right the second flexible hinge 80 is disposed between the second portion 77 of the surrounding sidewall 75 and the proximal margin 201 of the transparent cover 175, all shown in the partially open state of use with the light transmitting transparent cover 175 folded over the holder 65 for the article 55.

Figure 8:
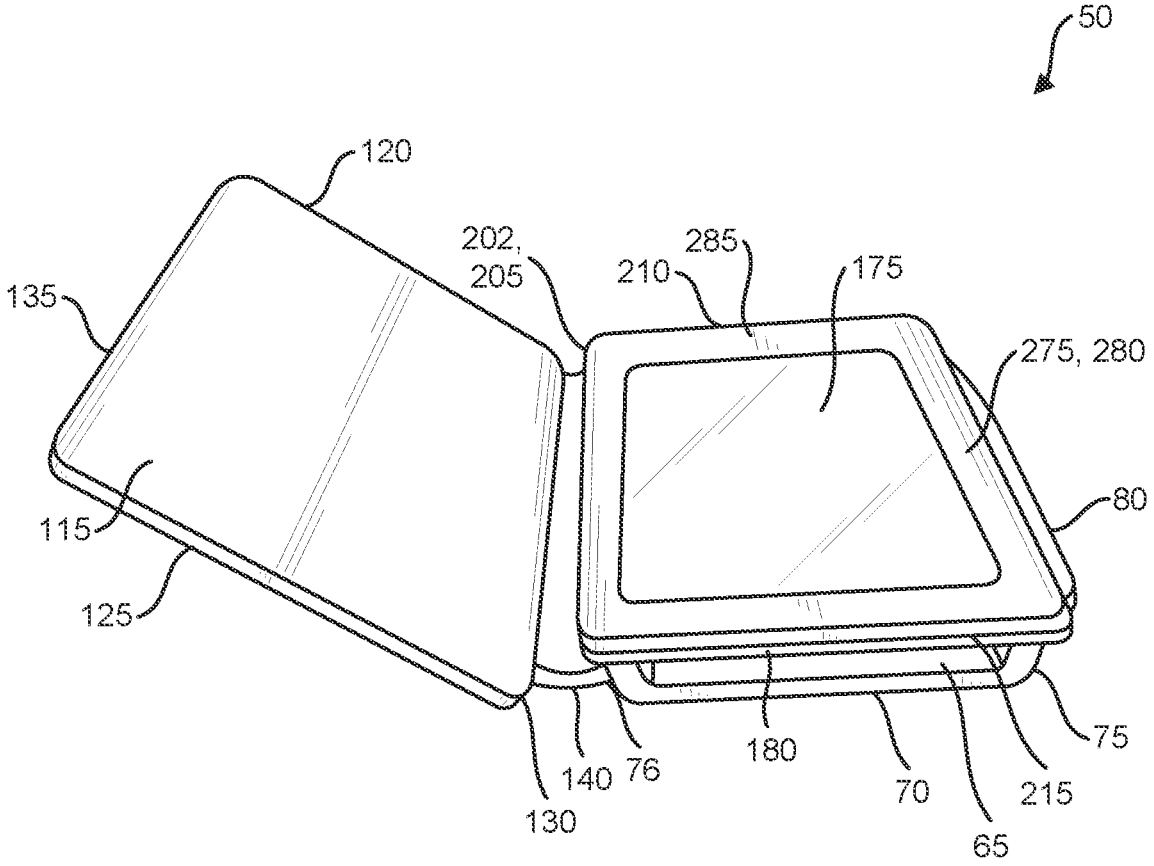
FIG. 8 is an upper perspective view of the articulated light transmitting transparent cover apparatus partially closed showing from left to right, the opaque cover that has the first flexible hinge that is disposed between the proximal margin of the opaque cover and the first portion of the surrounding sidewall extending from the base of the holder that is adapted to hold the article, further continuing being in a fully closed state, the second flexible hinge is disposed between the second portion of the surrounding sidewall and the proximal margin of the transparent cover, all showing the transparent cover in the fully closed over the holder with base and surrounding sidewall, with the opaque cover being in the partially open state.

Continuing, FIG. 8 is an upper perspective view of the articulated light transmitting transparent cover apparatus 50 partially closed showing from left to right, the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing being in a fully closed state. Further, in FIG. 8 the second flexible hinge 80 is disposed between the second portion 77 of the surrounding sidewall 75 and the proximal margin 201 of the transparent cover 175, all showing the transparent cover 175 in the fully closed state over the holder 65 with the base 70 and surrounding sidewall 75, with the opaque cover 115 being in the partially open state.

Figure 9:
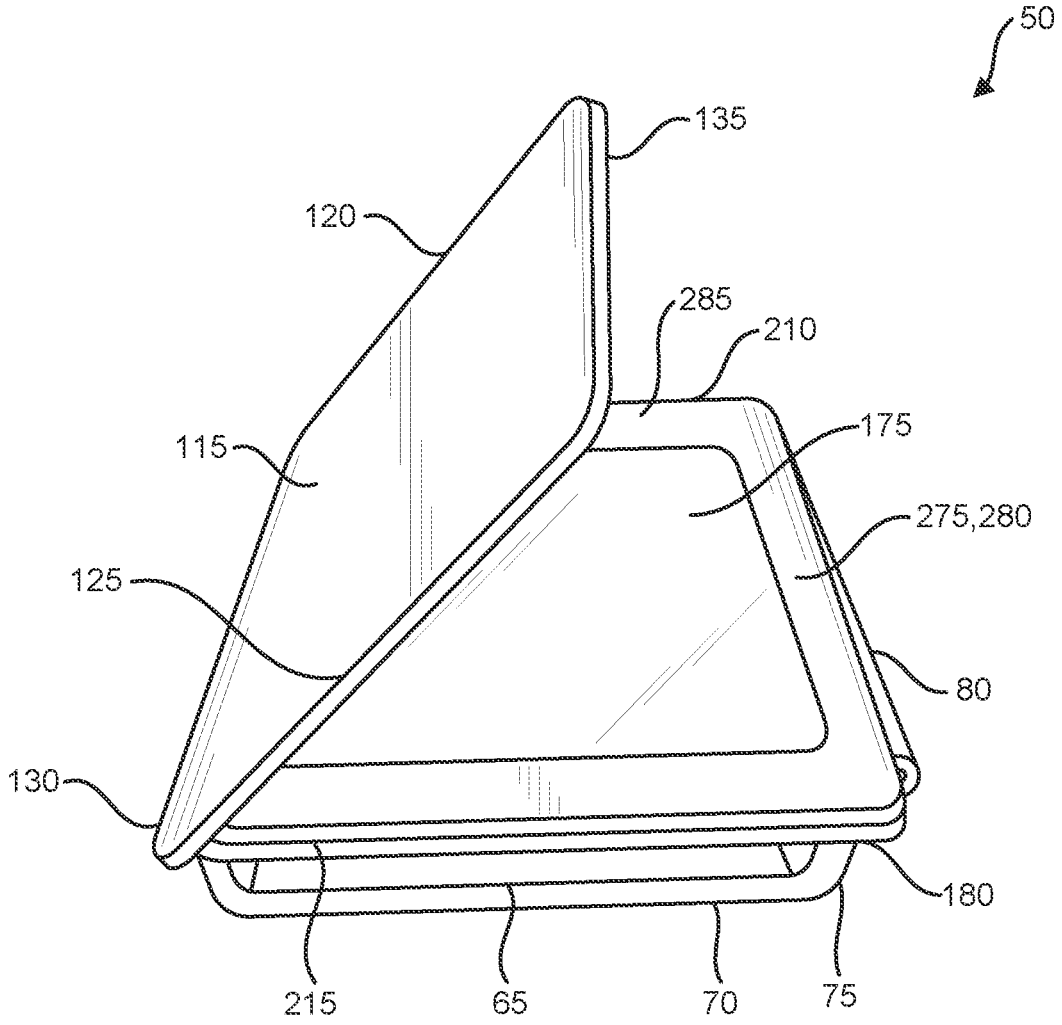
FIG. 9 is an upper perspective view of the articulated light transmitting transparent cover apparatus partially closed showing from left to right the opaque cover that has the first flexible hinge that is disposed between the proximal margin of the opaque cover and the first portion of the surrounding sidewall extending from the base of the holder that is adapted to hold the article, further continuing being in a fully closed state, the second flexible hinge is disposed between the second portion of the surrounding sidewall and the proximal margin of the transparent cover, all showing the transparent cover in the fully closed over the holder with base and surrounding sidewall, with the opaque cover being in the partially closed state.

Next, FIG. 9 is an upper perspective view of the articulated light transmitting transparent cover apparatus 50 partially closed showing from left to right the opaque cover 115 that has the first flexible hinge 140 that is disposed between the proximal margin 130 of the opaque cover 115 and the first portion 76 of the surrounding sidewall 75 extending from the base 70 of the holder 65 that is adapted to hold the article 55, further continuing being in a fully closed state, the second flexible hinge 80 is disposed between the second portion 77 of the surrounding sidewall 75 and the proximal margin 201 of the transparent cover 175, all showing the transparent cover 175 in the fully closed state over the holder 65 with base 70 and surrounding sidewall 75, with the opaque cover 115 being in the partially closed state.

Figure 10:
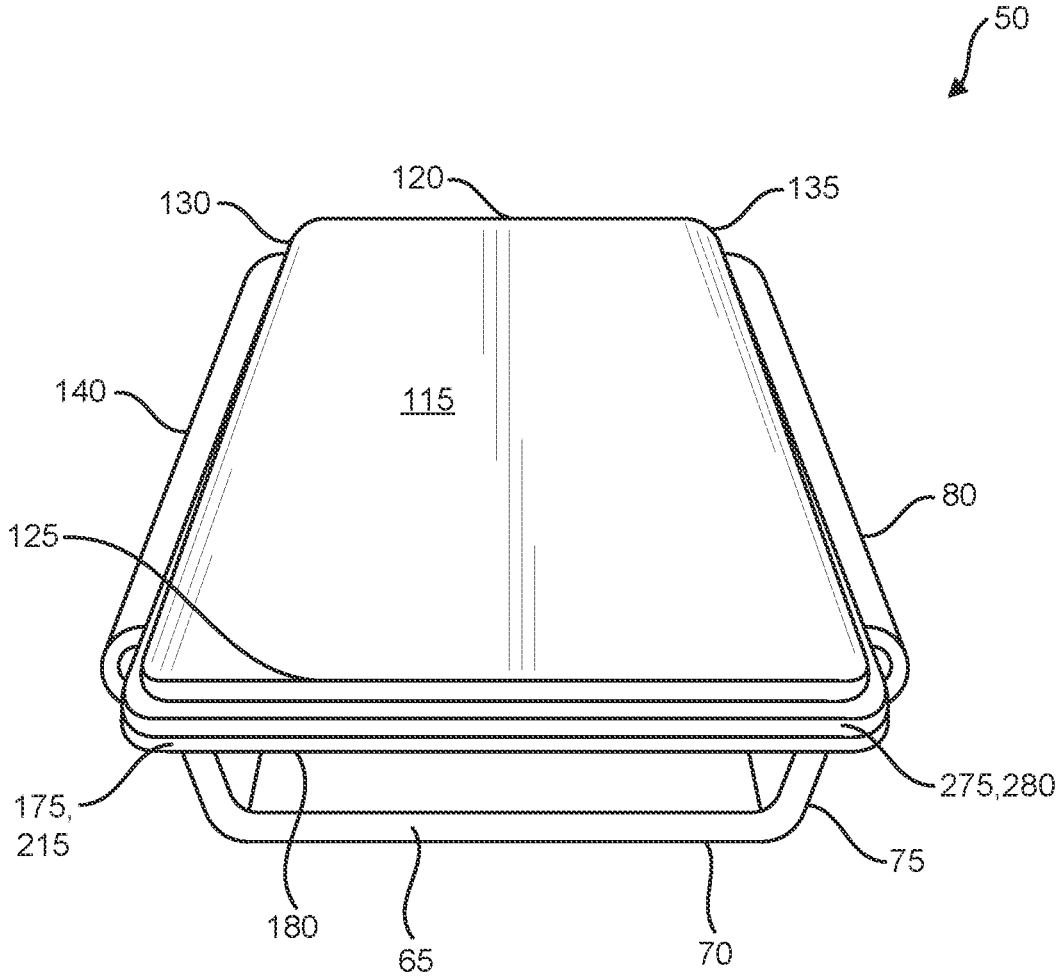
FIG. 10 is an upper perspective view of the articulated light transmitting transparent cover apparatus fully closed showing from left to right the first flexible hinge that is disposed between the proximal margin of the opaque cover and the first portion of the surrounding sidewall extending from the base of the holder that is adapted to hold the article, the opaque cover in the fully closed state over the transparent cover, next the transparent cover being in a fully closed state, the second flexible hinge that is disposed between the second portion of the surrounding sidewall and the proximal margin of the transparent cover, showing the transparent cover in the fully closed over the holder with base and surrounding sidewall.

Further, FIG. 10 is an upper perspective view of the articulated light transmitting transparent cover apparatus 50 fully closed showing from left to right the first flexible hinge 140 that is disposed between the proximal margin 130 of the opaque cover 115 and the first portion 76 of the surrounding sidewall 75 extending from the base 70 of the holder 65 that is adapted to hold the article 55. In FIG. 10, the opaque cover is in the fully closed state over the transparent cover 175, next the transparent cover 175 being in a fully closed state, the second flexible hinge 80 that is disposed between the second portion 77 of the surrounding sidewall 75 and the proximal margin 201 of the transparent cover 175, showing the transparent cover 175 in the fully closed state over the holder 65 with base 70 and surrounding sidewall 75.

Wherein, FIG. 10 shows the opaque cover 115 and the transparent cover 175 both in the fold flat closed state operationally.

Figure 11:
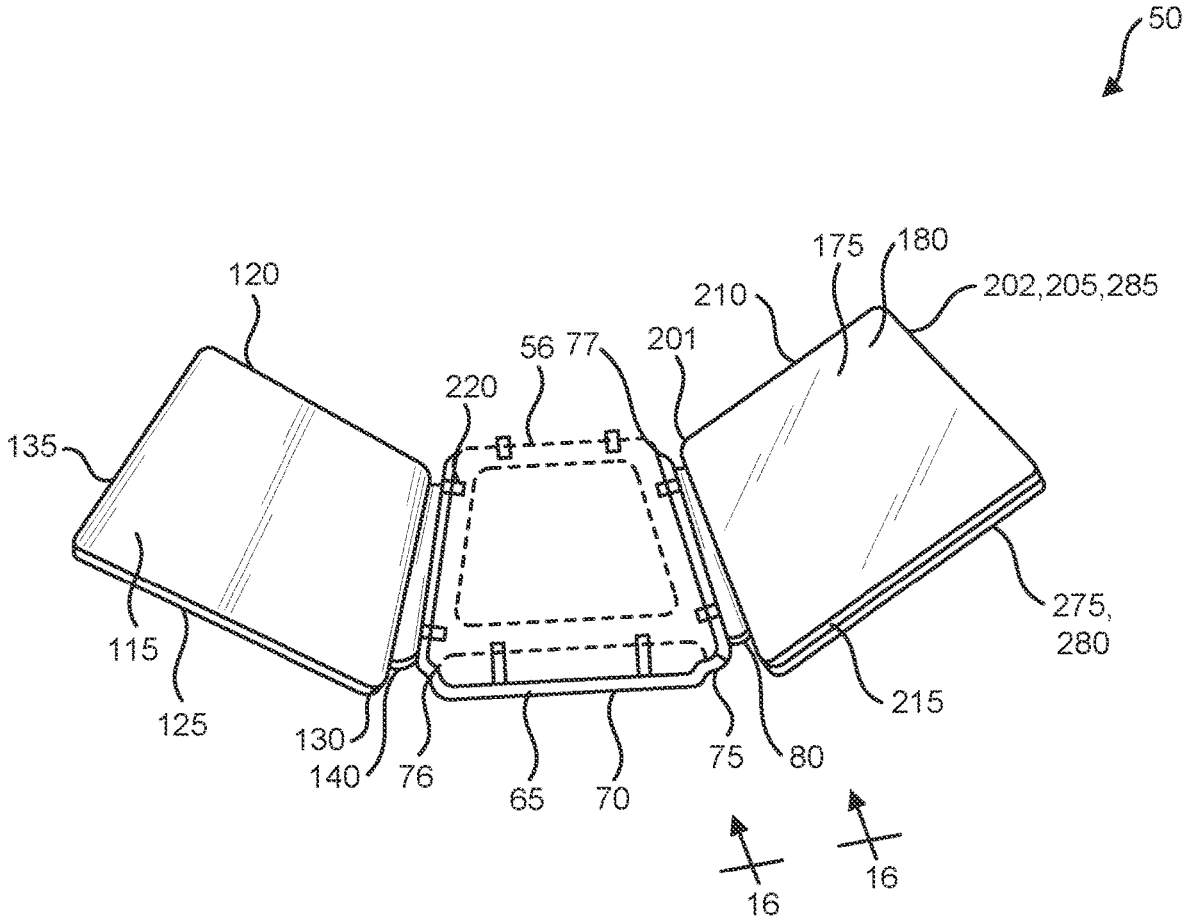
FIG. 11 is an upper perspective view of the articulated light transmitting transparent cover apparatus fully opened showing from left to right the opaque cover that has the first flexible hinge that is disposed between the proximal margin of the opaque cover and the first portion of the surrounding sidewall extending from the base of the holder that is showing the article with removably engageable clips that help hold the article in the holder as against the holder base and surrounding sidewall, further continuing from left to right the second flexible hinge is disposed between the second portion of the surrounding sidewall and the proximal margin of the transparent cover, all shown in the open state of use.

Continuing, FIG. 11 is an upper perspective view of the articulated light transmitting transparent cover apparatus 50 fully opened showing from left to right the opaque cover 115 that has the first flexible hinge 140 that is disposed between the proximal margin 130 of the opaque cover 115 and the first portion 76 of the surrounding sidewall 75 extending from the base 70 of the holder 65 that is showing the article 55 with removably engageable clips 220 that help hold the article 55 in the holder 65 as against the holder base 70 and surrounding sidewall 75, further continuing from left to right the second flexible hinge 80 is disposed between the second portion 77 of the surrounding sidewall 75 and the proximal margin 201 of the transparent cover 175, all shown in the open state of use.

Figure 12:
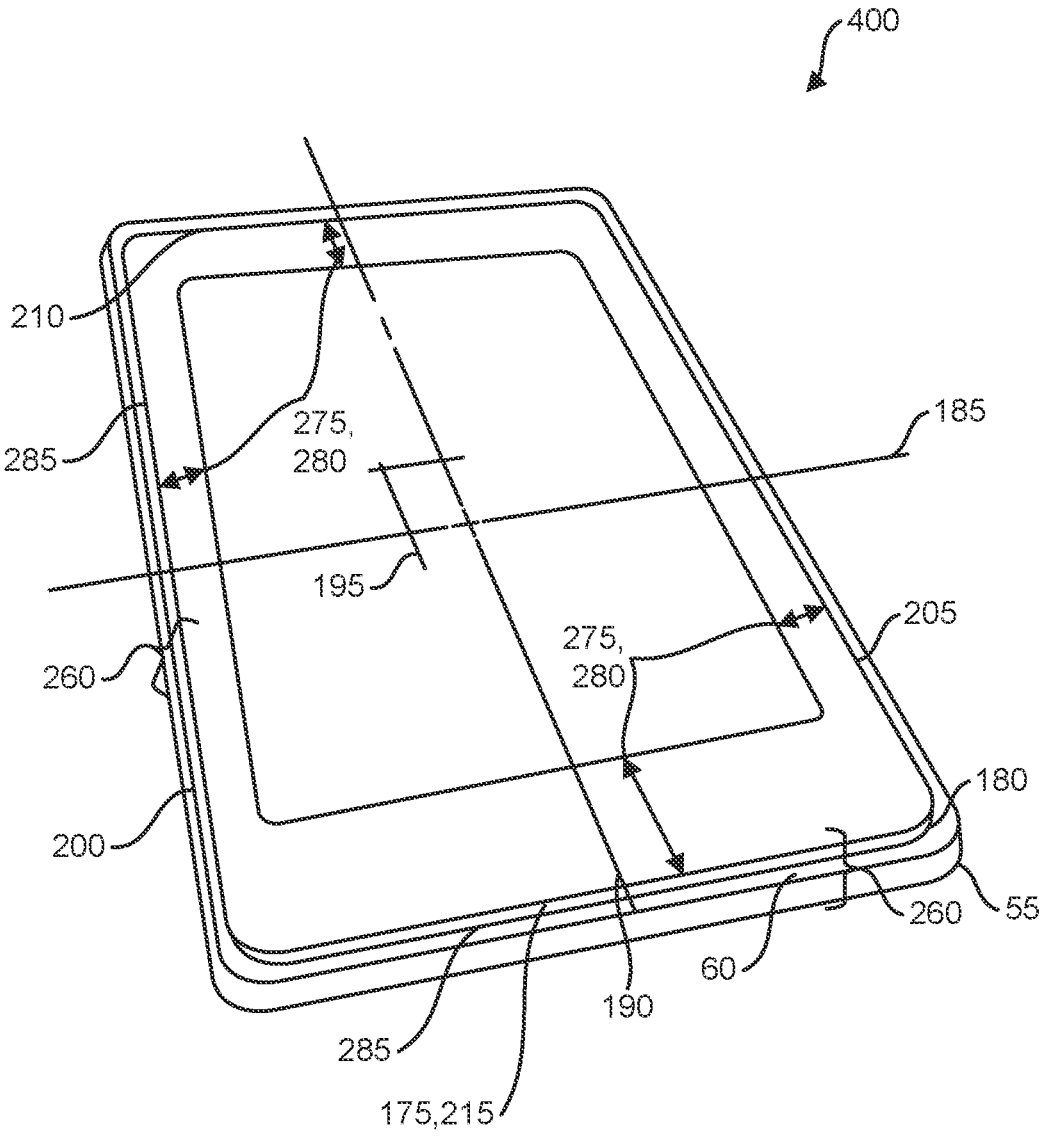
FIG. 12 shows an upper perspective view of the first alternate articulated light transmitting transparent cover apparatus with the light transmitting planar cover that is being used in its normal operating position being placed on the article display.

Next, FIG. 12 shows an upper perspective view of the first alternate articulated light transmitting transparent cover apparatus 400 with the light transmitting planar cover 175 that is being used in its normal operating position being placed on the article 55 display 60.

Figure 13:
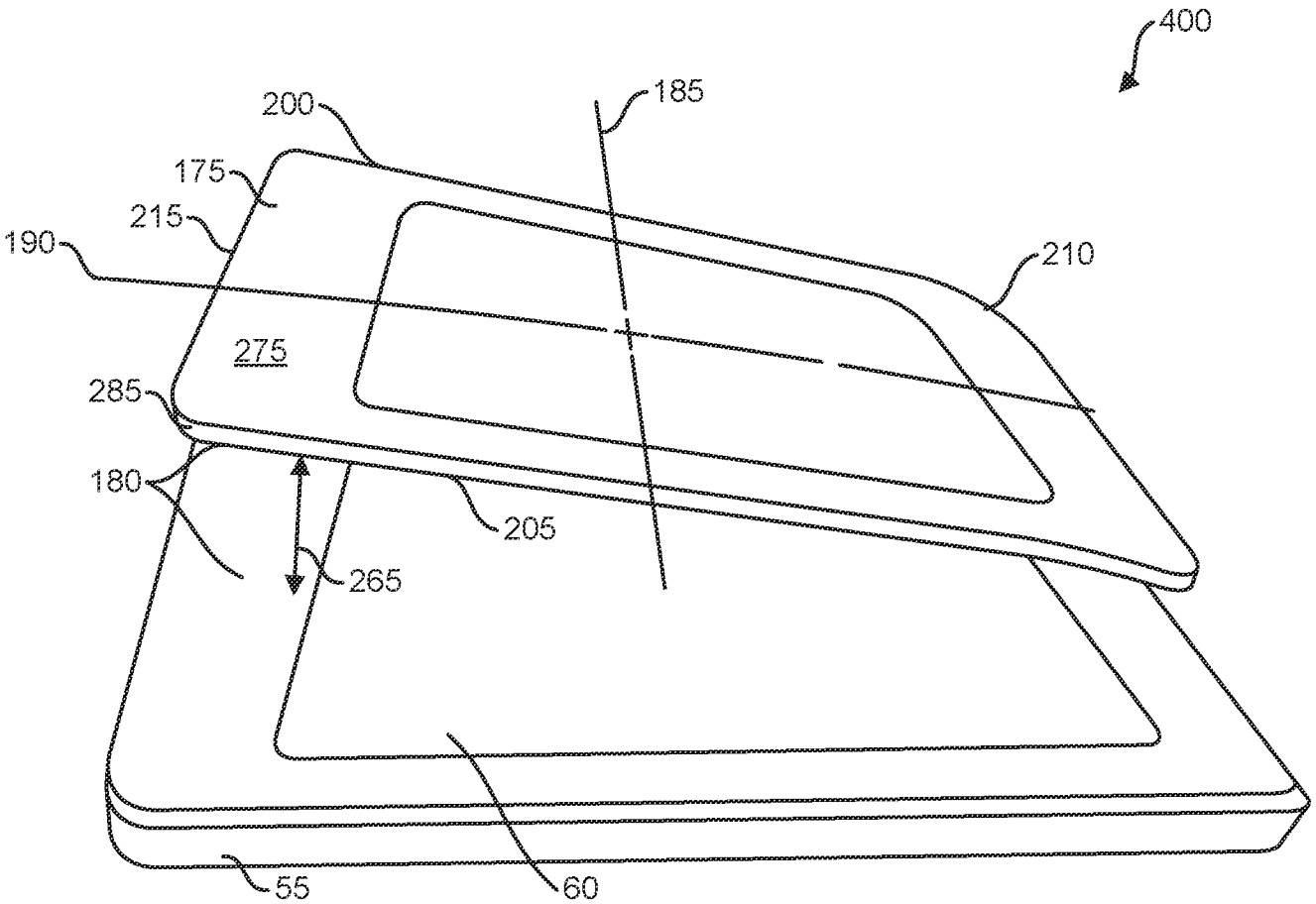
FIG. 13 shows a side elevation perspective view of the first alternate articulated light transmitting transparent cover apparatus with the light transmitting planar cover being placed toward being used in its normal operating position becoming near adjacent to the article display.

Continuing, FIG. 13 shows a side elevation perspective view of the first alternate articulated light transmitting transparent cover apparatus 400 with the light transmitting planar cover 175 being placed toward being used in its normal operating position becoming near adjacent to the article 55 display 60.

Figure 14:
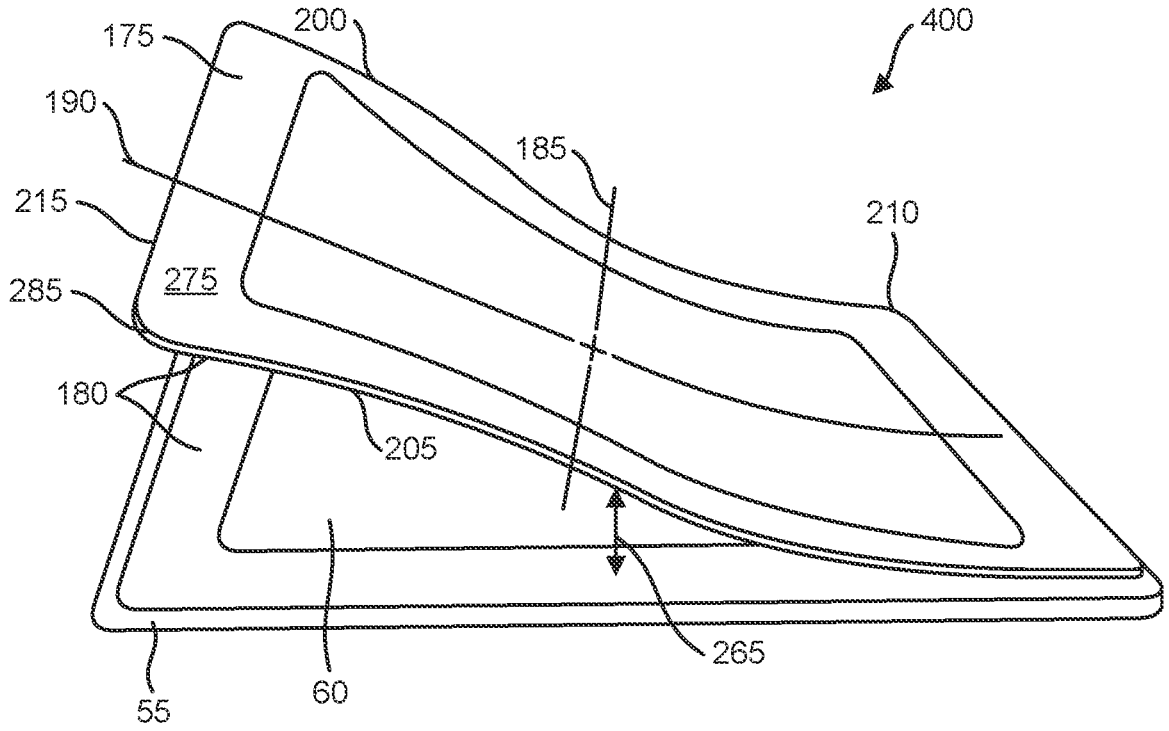
FIG. 14 shows a side elevation perspective view of the first alternate articulated light transmitting transparent cover apparatus with the light transmitting planar cover coming into contact with being used in its normal operating position becoming partially adjacent to the article display.

Continuing, FIG. 14 shows a side elevation perspective view of the first alternate articulated light transmitting transparent cover apparatus 400 with the light transmitting planar cover 175 coming into contact with being used in its normal operating position becoming partially adjacent to the article 55 display 60.

Figure 15:
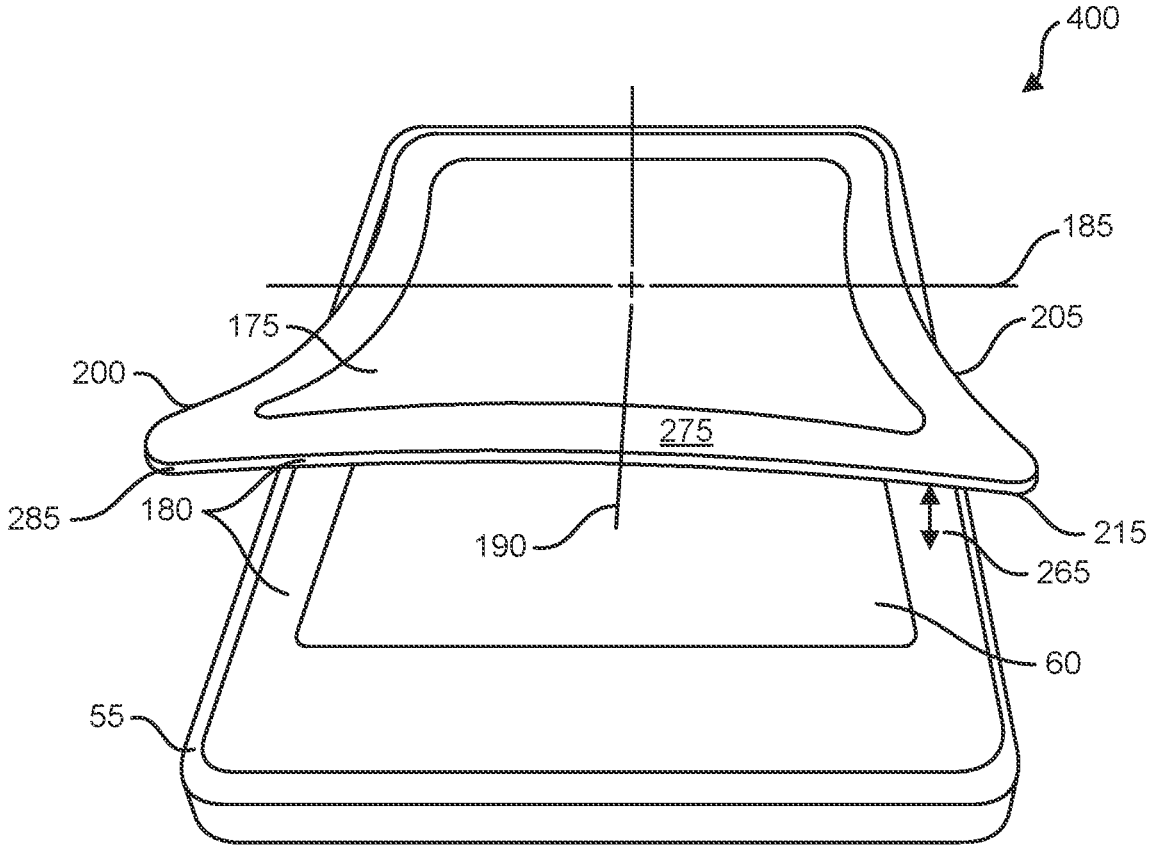
FIG. 15 shows a front elevation perspective view of the first alternate articulated light transmitting transparent cover apparatus with the light transmitting planar cover coming into contact with being used in its normal operating position becoming partially adjacent to the article display.

Next, FIG. 15 shows a front elevation perspective view of the first alternate articulated light transmitting transparent cover apparatus 400 with the light transmitting planar cover 175 coming into contact with being used in its normal operating position becoming partially adjacent to the article 55 display 60.

Figure 16:
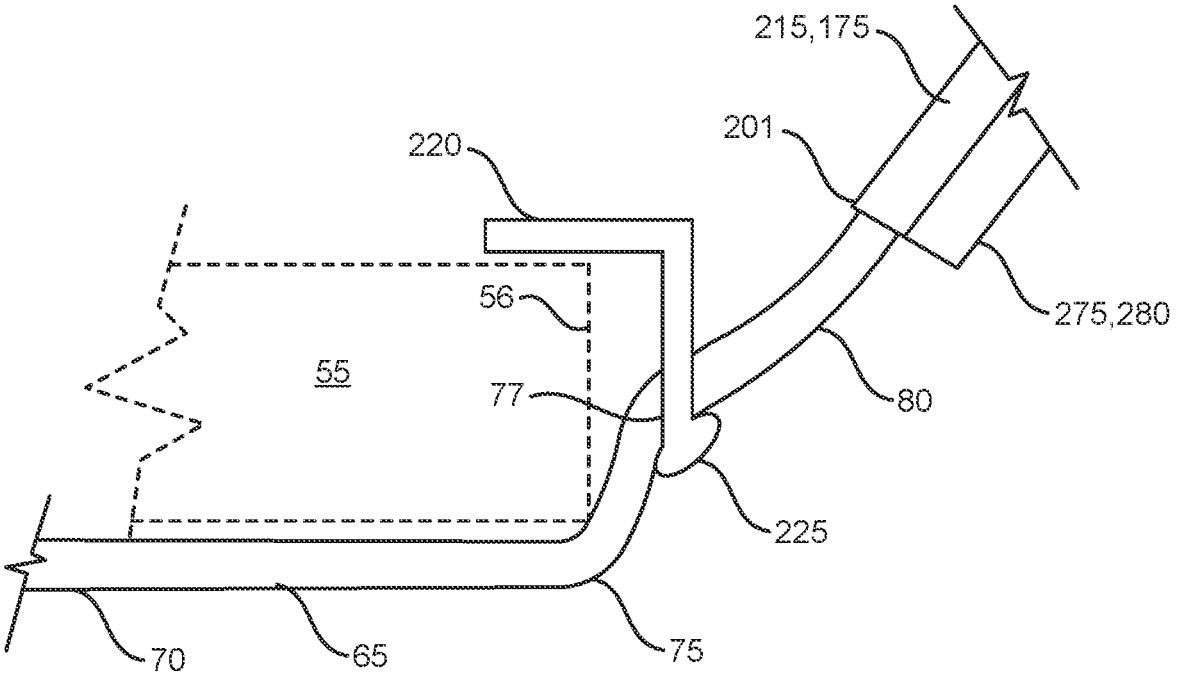

Subsequently, FIG. 16 is view 16-16 from FIG. 11, wherein FIG. 16 shows the removably engageable clip 220 being retained therethrough in the surrounding sidewall 75 adjacent to the second flexible hinge 80 with the clip 220 having an expanded portion 225 disposed on an opposing side of the surrounding sidewall 75 to help retain the clip 220 as against the article 55 outer periphery 56, thus helping to hold the article 55 within the holder 65 with the article 55 being nested against the surrounding sidewall 75 and base 70 all of the holder for the articulated light transmitting transparent cover apparatus 50. Note that as shown in FIG. 16, the clip 220 and expanded portion 225 could be disposed on the opposite side of the surrounding sidewall 75 adjacent to both the first 140 and second 80 flexible hinges for the second alternate embodiment 51 of the articulated light transmitting transparent cover apparatus 51 as shown in FIG. 19, plus further in FIGS. 17, 18, 20, and 21.

Figure 17:
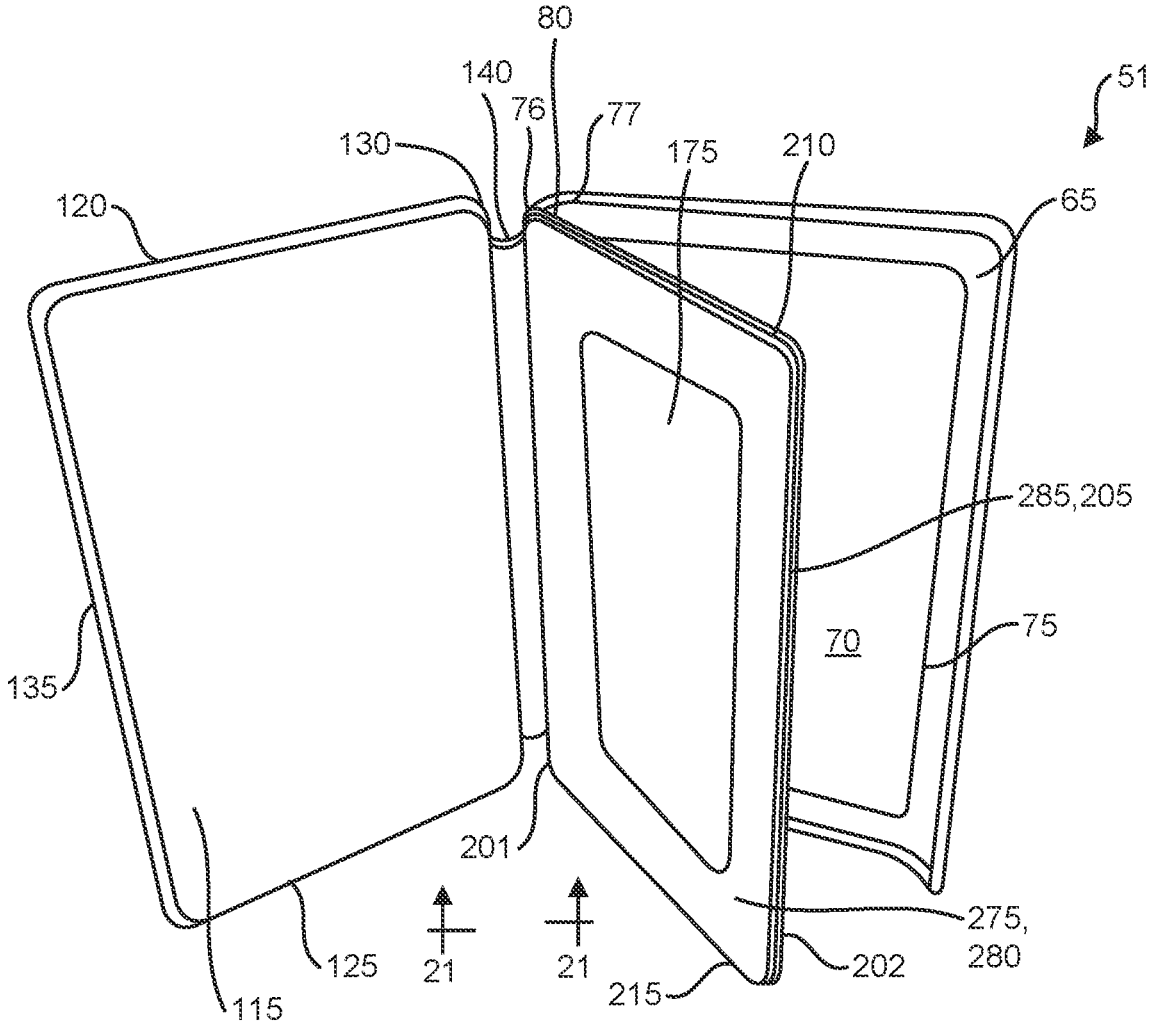
FIG. 17 shows a partially open view of the second alternate embodiment of the articulated light transmitting transparent cover apparatus that includes from left to right, the opaque cover, the first flexible hinge disposed between the proximal margin of the opaque cover and the first portion of the surrounding sidewall and base, the light transmitting transparent cover with the semi rigid border that forms a perimeter around the light transmitting transparent cover with the second flexible hinge that is disposed between proximal margin of the transparent cover and the second portion of the surrounding sidewall and base, and finally the article holder that includes the base and surrounding sidewall.

Further, FIG. 17 shows a partially open view of the second alternate embodiment 51 of the articulated light transmitting transparent cover apparatus 51 that includes from left to right, the opaque cover 115, the first flexible hinge 140 disposed between the proximal margin 130 of the opaque cover 115 and the first portion 76 of the surrounding sidewall 75 and base 70, the light transmitting transparent cover 175 with the semi rigid border 275 that forms a perimeter 280 around the light transmitting transparent cover 175 with the second flexible hinge 80 that is disposed between proximal margin 201 of the transparent cover 175 and the second portion 77 of the surrounding sidewall 75 and base 70, and finally the article holder 65 that includes the base 70 and surrounding sidewall 75. Wherein, FIG. 17 shows the opaque cover 115 and the transparent cover 175 both in a partially open state operationally.

Figure 18:
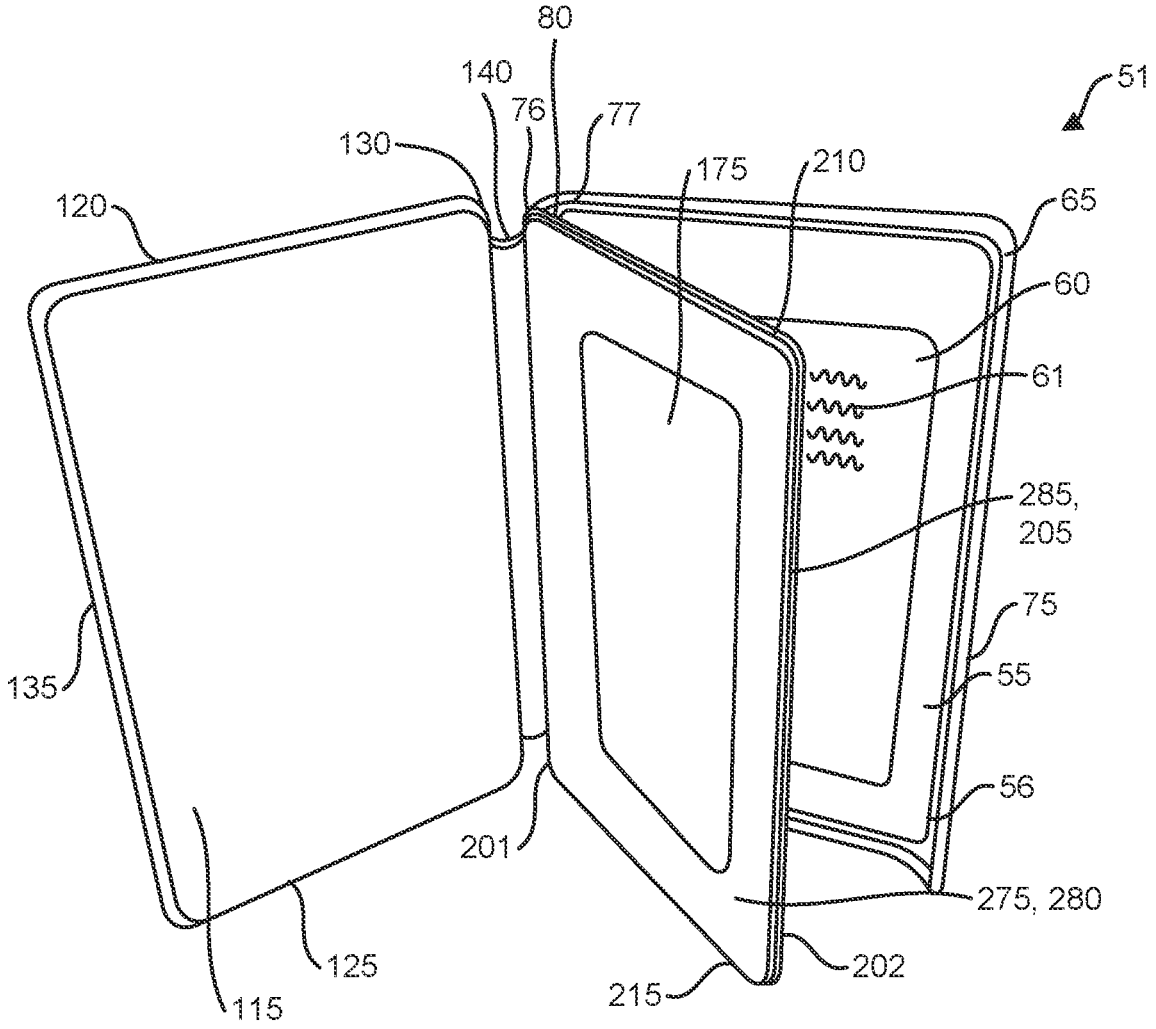
FIG. 18 shows a partially open view of the second alternate embodiment of the articulated light transmitting transparent cover apparatus that includes from left to right the opaque cover, the first flexible hinge disposed between the proximal margin of the opaque cover and the first portion of the surrounding sidewall and base, the light transmitting transparent cover with the semi rigid border that forms a perimeter around the light transmitting transparent cover with the second flexible hinge that is disposed between proximal margin of the transparent cover and the second portion of the surrounding sidewall and base, and finally the article holder that includes the base and surrounding sidewall, wherein the article is disposed within the holder with the article display and display screen text shown.

Next FIG. 18 shows a partially open view of the second alternate embodiment 51 of the articulated light transmitting transparent cover apparatus 51 that includes from left to right, the opaque cover 115, the first flexible hinge 140 disposed between the proximal margin 130 of the opaque cover 115 and the first portion 76 of the surrounding sidewall 75 and base 70, the light transmitting transparent cover 175 with the semi rigid border 275 that forms a perimeter 280 around the light transmitting transparent cover 175 with the second flexible hinge 80 that is disposed between proximal margin 201 of the transparent cover 175 and the second portion 77 of the surrounding sidewall 75 and base 70, and finally the article holder 65 that includes the base 70 and surrounding sidewall 75, wherein the article 55 is disposed within the holder 65 with the article display 60 and display screen text 61 shown. Wherein, FIG. 18 shows the opaque cover 115 and the transparent cover 175 both in a partially open state operationally.

Figure 19:
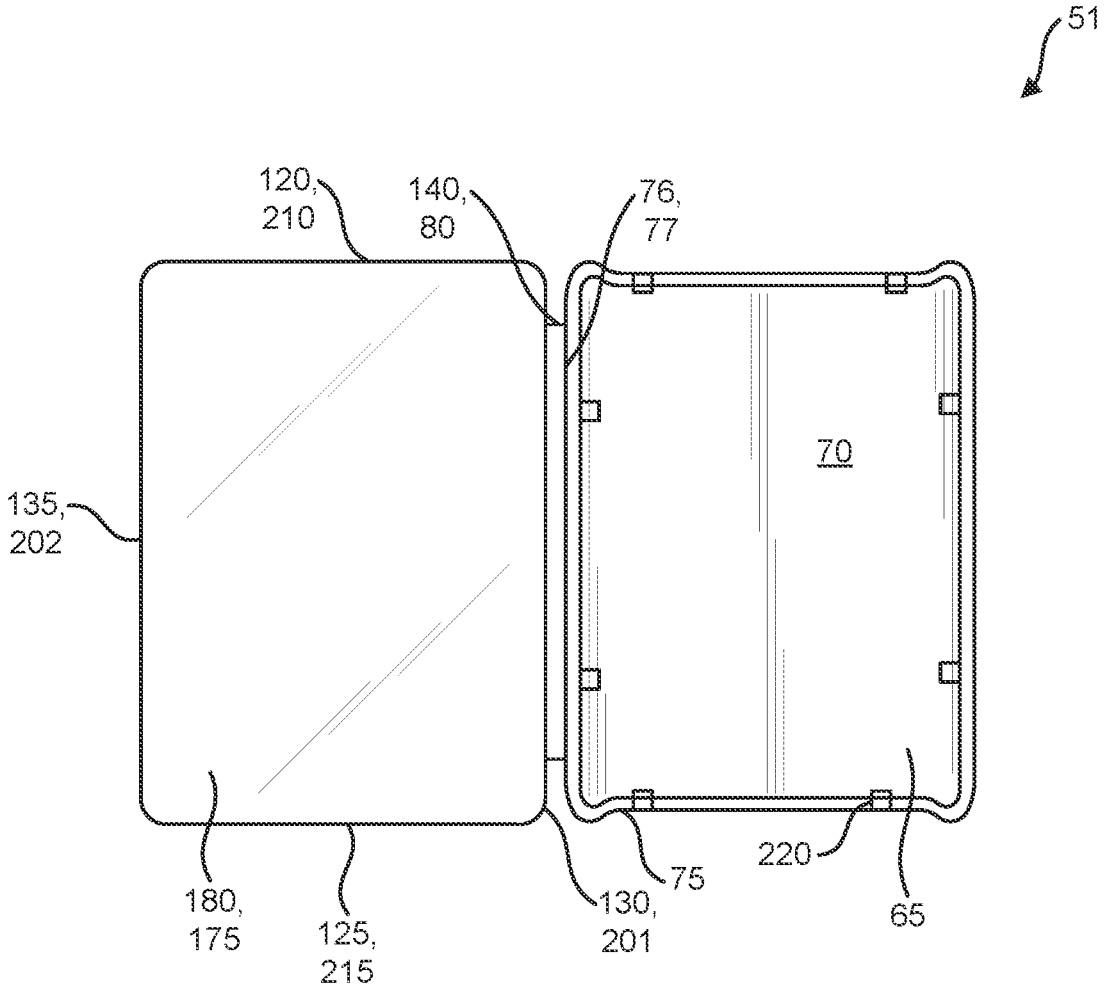
FIG. 19 shows a fully open view of the second alternate embodiment of the articulated light transmitting transparent cover apparatus that includes from left to right the opaque cover, the first flexible hinge disposed between the proximal margin of the opaque cover and the first portion of the surrounding sidewall and base, the light transmitting transparent cover displaced over the opaque cover with the semi rigid border that forms a perimeter around the light transmitting transparent cover (hidden from view in this FIG. 19) with the second flexible hinge that is disposed between proximal margin of the transparent cover and the second portion of the surrounding sidewall and base, and finally the article holder that includes the base and surrounding sidewall with the removably engageable clips shown disposed within the holder surrounding sidewall.

Further, FIG. 19 shows a fully open view of the second alternate embodiment 51 of the articulated light transmitting transparent cover apparatus 51 that includes from left to right the opaque cover 115, the first flexible hinge 140 disposed between the proximal margin 130 of the opaque cover 115 and the first portion 76 of the surrounding sidewall 75 and base 70, the light transmitting transparent cover 175 displaced over the opaque cover 115 with the semi rigid border 275 that forms a perimeter 280 around the light transmitting transparent cover 175 (hidden from view in this FIG. 19) with the second flexible hinge 80 that is disposed between proximal margin 201 of the transparent cover 175 and the second portion 77 of the surrounding sidewall 75 and base 70. Finally, FIG. 19 shows the article holder 65 that includes the base 70 and surrounding sidewall 75 with the removably engageable clips 220 shown disposed within the holder 65 surrounding sidewall 75. Wherein, FIG. 19 shows the opaque cover 115 and the transparent cover 175 both in a fold flat open state operationally, wherein the opaque cover 115 and the transparent cover 175 are on top of or adjacent to one another in the fold flat open state relative to the article holder.

Figure 20:
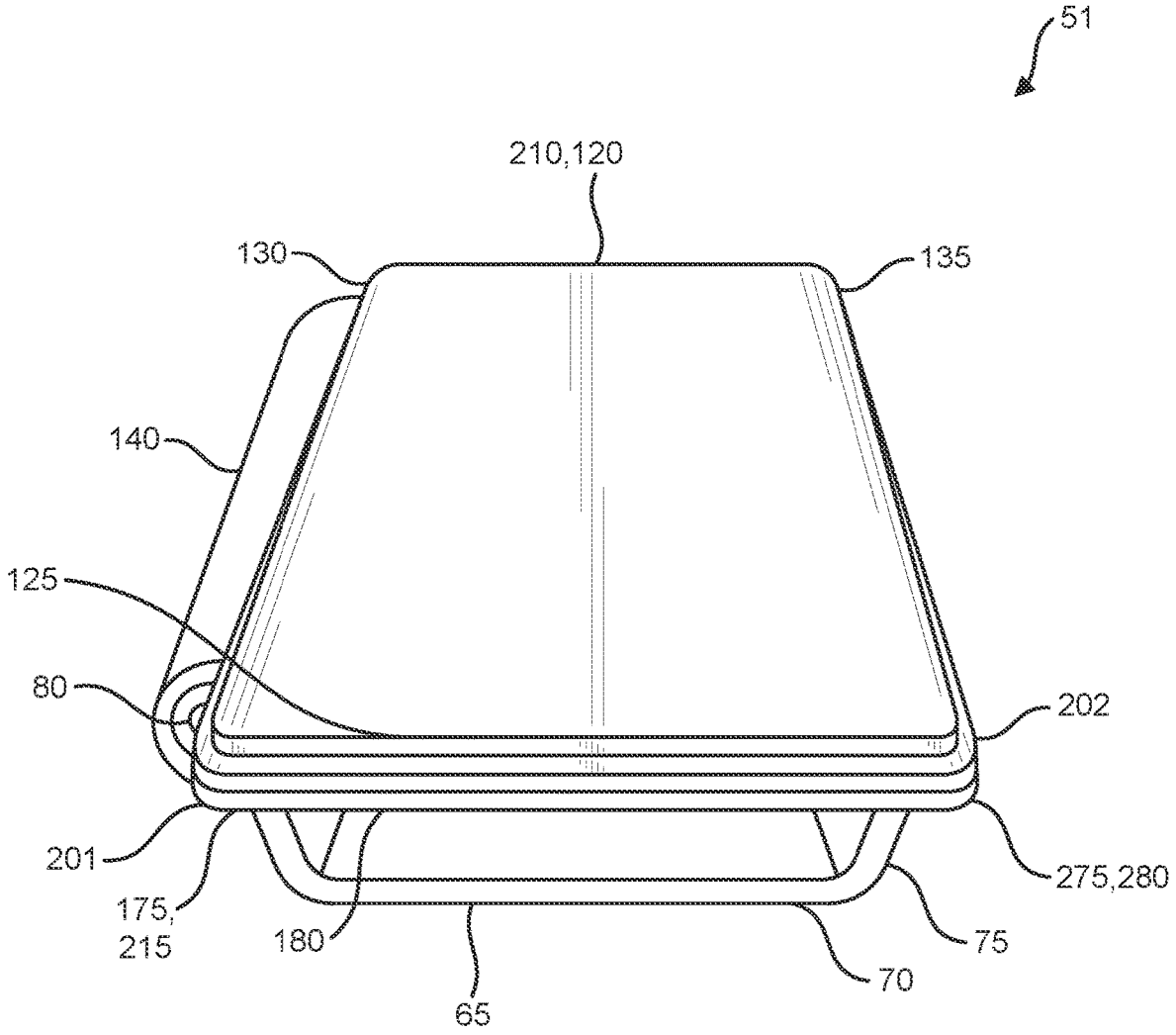
FIG. 20 shows a fully closed view of the second alternate embodiment of the articulated light transmitting transparent cover apparatus that includes from left to right the opaque cover, the first flexible hinge disposed between the proximal margin of the opaque cover and the first portion of the surrounding sidewall and base, the opaque cover being disposed over the light transmitting transparent cover with the semi rigid border that forms a perimeter around the light transmitting transparent cover (hidden from view in this FIG. 20) with the second flexible hinge that is disposed between proximal margin of the transparent cover and the second portion of the surrounding sidewall and base, and finally the article holder that includes the base and surrounding sidewall.

Continuing, FIG. 20 shows a fully closed view of the second alternate embodiment 51 of the articulated light transmitting transparent cover apparatus 51 that includes from left to right, the opaque cover 115, the first flexible hinge 140 disposed between the proximal margin 130 of the opaque cover 115 and the first portion 76 of the surrounding sidewall 75 and base 70, the opaque cover 115 being disposed over the light transmitting transparent cover 175 with the semi rigid border 275 that forms a perimeter 280 around the light transmitting transparent cover 175 (hidden from view in this FIG. 20) with the second flexible hinge 80 that is disposed between proximal margin 201 of the transparent cover 175 and the second portion 77 of the surrounding sidewall 75 and base 70, and finally the article holder 65 that includes the base 70 and surrounding sidewall 75. Wherein, FIG. 20 shows the opaque cover 115 and the transparent cover 175 both in a fold flat closed state operationally, wherein the opaque cover 115 and the transparent cover 175 are on top of or adjacent to one another in the fold flat closed state over the article holder 65.

Figure 21:
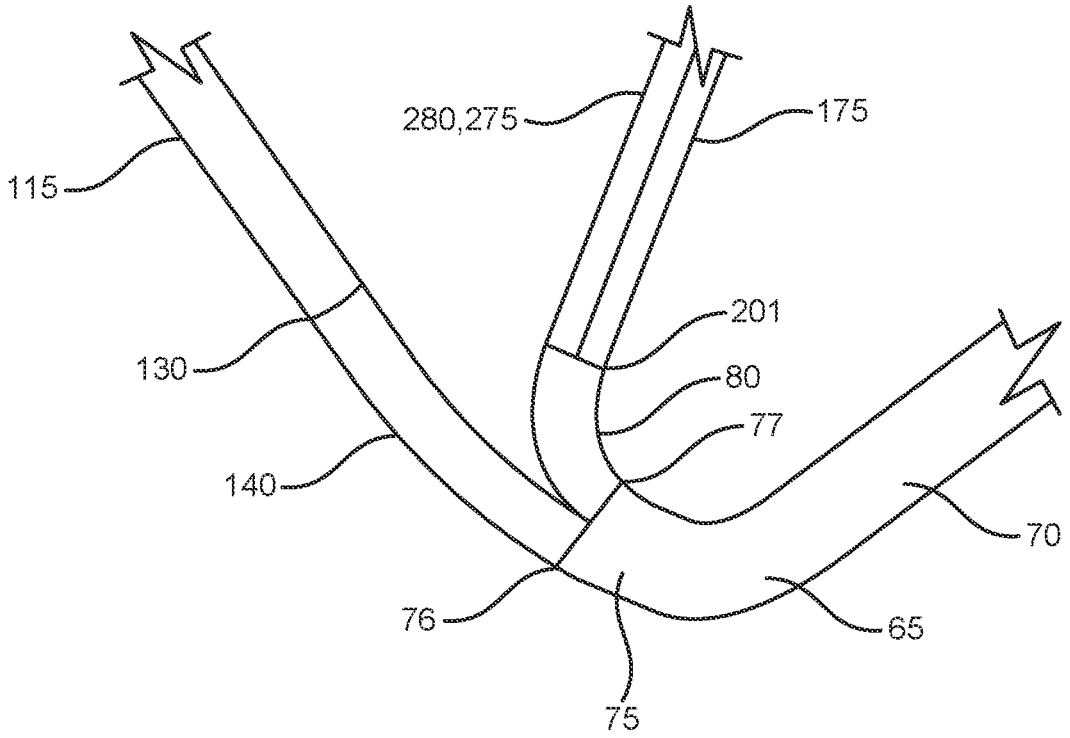

Further, FIG. 21 is view 21-21 from FIG. 17, wherein FIG. 21 shows the portfolio style of the first 140 and second 80 flexible hinges of the second alternate embodiment 51 of the articulated light transmitting transparent cover apparatus 51, wherein the holder 65 surrounding sidewall 75 and base 70 are attached to both the first 140 and second 80 flexible hinges at respectively at the first 76 and second 77 portions of the surrounding sidewall 75 and base 70, with the first flexible hinge 140 supporting the opaque cover 115 proximal margin 130 and the second flexible hinge 80 supporting the light transmitting transparent cover 175 proximal margin 201, wherein the first 140 and second 80 flexible hinges are nested to one another as FIG. 21 shows.

Referring to FIGS. 1 to 11 in particular, for the articulated light transmitting transparent cover apparatus 50 that is adapted to attach to the article 55 having the outer periphery 56 and the display 60, the articulated light transmitting cover apparatus 50, includes the article holder 65 that includes the base 70 and the surrounding sidewall 75 extending therefrom the base 70, wherein the article holder 65 forms a nesting holder 65 for the article 55 and the article outer periphery 56, further the surrounding sidewall 75 and the base 70 includes a first portion 76 and the surrounding sidewall 75 and the base 70 includes an opposing second portion 77.

Further included in the articulated light transmitting transparent cover apparatus 50, is the opaque cover 115 having the opaque cover initial end portion 120 and the opposing opaque cover 115 subsequent end portion 125, the opaque cover 115 further including the opaque cover 115 distal margin 135 and the opposing opaque cover 115 proximal margin 130.

The articulated light transmitting transparent cover apparatus 50 also includes the first flexible hinge 140 disposed between the opaque cover 115 proximal margin 130 and the surrounding sidewall 75 and the base first portion 76, wherein, operationally the opaque cover 115 has an opaque cover 115 fold flat open state, see FIGS. 1 and 2 and pivots via the first flexible hinge 140 toward closing over the article holder 65 in an opaque cover 115 fold flat closed state, see FIGS. 9 and 10.

The articulated light transmitting transparent cover apparatus 50 further includes the light transmitting transparent cover 175 having the transparent cover 175 initial end portion 210 and the opposing transparent cover 175 subsequent end portion 215, the transparent cover 175 further including the transparent cover 175 distal margin 202 and the opposing transparent cover 175 proximal margin 201.

The articulated light transmitting transparent cover apparatus 50 in addition also includes the second flexible hinge 80 disposed between the transparent cover 175 proximal margin 201 and the surrounding sidewall 75 and the base 70 second portion 77, wherein operationally the transparent cover 175 has the transparent cover 175 fold flat open state, see FIGS. 1 to 5, that pivots via the second flexible hinge 80 toward closing over the article holder 65 in a transparent cover 175 fold flat closed state, see FIG. 10.

As an option for the articulated light transmitting transparent cover apparatus 50, it can further comprise the removably engageable flexible clip 220 that is disposed therethrough the surrounding sidewall 75, wherein the flexible clip 220 projects over a portion of the base 70 being operational to engage a portion of the article 55 outer periphery 56 to help retain the article 55 to the article holder 65 including the base 70 and the surrounding sidewall 75, see FIGS. 1, 11, and 16.

As another option for the articulated light transmitting transparent cover apparatus 50, wherein the flexible clip 220 can further include the expanded portion 225 that is positioned opposite of the flexible clip 220 projecting over the portion of the base 70 all in relation to the surrounding sidewall 75, wherein operationally the expanded portion 225 helps to retain the flexible clip 220 within the surrounding sidewall 75, see FIGS. 1, 11, and 16.

As a further option for the articulated light transmitting transparent cover apparatus 50, it can further comprise a removably engageable flexible clip 220 that is disposed therethrough the first 140 or second 80 flexible hinge, wherein the flexible clip 220 projects over a portion of the base 70 being operational to engage a portion of the article 55 outer periphery 56 to help retain the article 55 to the article holder 65 including the base 70 and the surrounding sidewall 75, see FIGS. 1, 11, and 16.

As another alternative for the articulated light transmitting transparent cover apparatus 50, wherein the flexible clip 220 can further include an expanded portion 225 that is positioned opposite of the clip 220 projecting over the portion of the base 70 all in relation to the first 140 or second 80 flexible hinge, wherein operationally the expanded portion 225 helps to retain the flexible clip within the first 140 or second 80 flexible hinge, see FIGS. 1, 11, and 16.

As a continuing alternative for the articulated light transmitting transparent cover apparatus 50, it can further comprise a connector structure portion 85 that is positioned adjacent to the base 70 opposite of the surrounding sidewall 75 extension from the base 70, wherein the connector structure 85 is disposed between the first flexible hinge 140 and the second flexible hinge 80, the connector structure 85 provides a one-piece continuous outer surface as between the opaque cover 115, the first flexible hinge 140, the connector structure 85, the second flexible hinge 80, and the light transmitting transparent cover 175 for the articulated light transmitting cover apparatus 50 for operationally easier hand grasping and clothing pocket manual insertion and removal, see FIGS. 2, 3, and 4.

As a next alternative for the articulated light transmitting transparent cover apparatus 50, wherein the light transmitting transparent cover 175 has a smooth side that is adjacent to the surrounding sidewall 75 extending from the base 70 side in the transparent cover 175 moving toward closing over the article holder 65 surrounding sidewall 75 side in the transparent cover 175 fold flat closed state, see FIGS. 6, 7, and 8, and the transparent cover 175 including the semi-rigid border 275 forming the perimeter 280 around the transparent cover 175, wherein the semi-rigid border 275 is disposed on the transparent cover 175 on a side opposite of the transparent cover 175 smooth side, wherein operationally the semi-rigid border 275 facilitates easier hand grasping of the transparent cover 175 and helps the light transmitting transparent cover 175 remain substantially planar in shape, see FIGS. 1 to 3 and FIGS. 6 to 11.

As another alternative for the articulated light transmitting transparent cover apparatus 50, wherein the semi-rigid border 275 is sized and configured to create a reduced transparent area of the transparent cover 175 to substantially match a display area of the article 55 display 60 to operationally facilitate a display light of the article 55 to be substantially only directed therethrough the transparent cover 175 reduced transparent area within said semi-rigid border 275, again see FIGS. 1 to 3 and FIGS. 6 to 11.

Referring in particular to FIGS. 12 to 15, the present invention is of the first alternate embodiment 400 articulated light transmitting transparent cover apparatus 400 that is adapted to attach to an article 55 with the display 60, the cover apparatus 400 including a light transmitting planar cover 175 that is adapted to be removably adjacent 180 to the article 55 display 60, the light transmitting cover 175 having the cover lengthwise axis 185 and a perpendicularly positioned 195 cover crosswise axis 190, further the light transmitting cover 175 has the cover primary margin 200 and an opposing cover secondary margin 205 with the cover lengthwise axis 185 spanning therebetween, in addition the light transmitting cover 175 has a cover initial end portion 210 and an opposing cover subsequent end portion 215 with the cover crosswise axis 190 spanning therebetween.

Referring in particular to FIGS. 16 to 21, for the second alternate embodiment 51 of an articulated light transmitting transparent cover apparatus 51 that is adapted to attach to the article 55 having the outer periphery 56 and the display 60, the second alternate embodiment 51 articulated light transmitting transparent cover apparatus 51, including an article holder 65 that includes a base 70 and a surrounding sidewall 75 extending therefrom the base 70, wherein the article holder 65 forms a nesting holder for the article 55 and the article outer periphery 56, further the surrounding sidewall 75 and the base 70 includes a first portion 76 and the surrounding sidewall 75 and the base includes a same side second portion 77.

Also included for the second alternate embodiment 51 of an articulated light transmitting transparent cover apparatus 51, is an opaque cover 115 having an opaque cover 115 initial end portion 120 and an opposing opaque cover 115 subsequent end portion 125, the opaque cover 115 further including and an opaque cover 115 distal margin 135 and an opposing opaque cover 115 proximal margin 130.

Further included for the second alternate embodiment 51 of an articulated light transmitting transparent cover apparatus 51, is a first flexible hinge 140 disposed between the opaque cover 115 proximal margin 130 and the surrounding sidewall 75 and the base 70 first portion 76, wherein operationally the opaque cover 115 has an opaque cover 115 fold flat open state, see FIG. 19, and pivots via the first flexible hinge 140 toward closing over the article holder 65 in an opaque cover 115 fold flat closed state, see FIG. 20.

Additionally, included for the second alternate embodiment 51 of an articulated light transmitting transparent cover apparatus 51, is a light transmitting transparent cover 175 having a transparent cover 175 initial end portion 210 and an opposing transparent cover 175 subsequent end portion 215, the transparent cover 175 further including a transparent cover 175 distal margin 202 and an opposing transparent cover 175 proximal margin 201.

Further, included for the second alternate embodiment 51 of an articulated light transmitting transparent cover apparatus 51, is a second flexible hinge 80 disposed between the transparent cover 175 proximal margin 201 and the surrounding sidewall 75 and the base 70 second portion 77, wherein operationally the transparent cover 175 has a transparent cover fold flat open state, see FIG. 19, and pivots via the second flexible hinge 80 toward closing over the article holder 65 in a transparent cover 175 fold flat closed state, see FIG. 20, with the second alternative embodiment 51 of the articulated light transmitting transparent cover apparatus 51 having a portfolio style or book style configuration of the first 140 and second 80 flexible hinges relative to one another.

As an option for the second alternate embodiment 51 of an articulated light transmitting transparent cover apparatus 51, it can further comprise the removably engageable flexible clip 220 that is disposed therethrough the surrounding sidewall 75, wherein the flexible clip 220 projects over a portion of the base 70 being operational to engage a portion of the article 55 outer periphery 56 to help retain the article 55 to the article holder 65 including the base 70 and the surrounding sidewall 75, see FIGS. 16 and 19.

As a further option for the second alternate embodiment 51 of an articulated light transmitting transparent cover apparatus 51, wherein the flexible clip 220 can further include the expanded portion 225 that is positioned opposite of the flexible clip 220 projecting over the portion of the base 70 all in relation to the surrounding sidewall 75, wherein operationally, the expanded portion 225 helps to retain the flexible clip 220 within the surrounding sidewall 75, see FIGS. 16 and 19.

As another further option for the second alternate embodiment 51 of an articulated light transmitting transparent cover apparatus 51, can further comprise a removably engageable flexible clip 220 that is disposed therethrough the first 140 or second 80 flexible hinge, wherein the flexible clip 220 projects over a portion of the base 70 being operational to engage a portion of the article 55 outer periphery 56 to help retain the article 55 to the article holder 65 including the base 70 and the surrounding sidewall 75, see FIGS. 16 and 19.

As a continuing further option for the second alternate embodiment 51 of an articulated light transmitting transparent cover apparatus 51, wherein the flexible clip 220 can further include an expanded portion 225 that is positioned opposite of the clip 220 projecting over the portion of the base 70 all in relation to the first 140 or second 80 flexible hinge, wherein operationally the expanded portion 225 helps to retain the flexible clip within the first 140 or second 80 flexible hinge, see FIGS. 16 and 19.

As a further option for the second alternate embodiment 51 of an articulated light transmitting transparent cover apparatus 51, wherein the light transmitting transparent cover 175 has a smooth side that is adjacent to the surrounding sidewall 75 extending from the base 70 side in the transparent cover 175 moving toward closing over the article holder 65 surrounding sidewall 75 side in the transparent cover 175 fold flat closed state, see FIG. 20, and the transparent cover 175 including the semi-rigid border 275 forming the perimeter 280 around the transparent cover 175, wherein the semi-rigid border 275 is disposed on the transparent cover 175 on a side opposite of the transparent cover 175 smooth side. Wherein operationally, the semi-rigid border 275 facilitates easier hand grasping of the transparent cover 175 and helps the light transmitting transparent cover 175 remain substantially planar in shape, see FIGS. 17 to 21.

As a further option for the second alternate embodiment 51 of an articulated light transmitting transparent cover apparatus 51, wherein the semi-rigid border 275 is sized and configured to create a reduced transparent area of the transparent cover 175 to substantially match a display area of the article 55 display 60 to operationally facilitate a display light of the article 55 to be substantially only directed therethrough the transparent cover 175 reduced transparent area within said semi-rigid border 275, see FIG. 18.

CONCLUSION

Accordingly, the present invention of an articulated light transmitting transparent cover apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. An articulated light transmitting transparent cover apparatus that is adapted to attach to an article having an outer periphery and a display, said articulated light transmitting transparent cover apparatus, comprising:

(a) an article holder that includes a base and a surrounding sidewall extending therefrom said base, wherein said article holder forms a nesting holder for the article and the article outer periphery, further said surrounding sidewall and said base includes a first portion and said surrounding sidewall and said base includes an opposing second portion;

(b) an opaque cover having an opaque cover initial end portion and an opposing opaque cover subsequent end portion, said opaque cover further including and an opaque cover distal margin and an opposing opaque cover proximal margin;

(c) a first flexible hinge disposed between said opaque cover proximal margin and said surrounding sidewall and said base first portion, wherein operationally said opaque cover has an opaque cover fold flat open state and pivots via said first flexible hinge toward closing over said article holder in an opaque cover fold flat closed state;

(d) a light transmitting transparent cover having a transparent cover initial end portion and an opposing transparent cover subsequent end portion, said transparent cover further including a transparent cover distal margin and an opposing transparent cover proximal margin; and (e) a second flexible hinge disposed between said transparent cover proximal margin and said surrounding sidewall and said base second portion, wherein operationally said transparent cover has a transparent cover fold flat open state and pivots via said second flexible hinge toward closing over said article holder in a transparent cover fold flat closed state, wherein said light transmitting transparent cover has a smooth side that is adjacent to said surrounding sidewall extending from said base side in said transparent cover moving toward closing over said article holder surrounding sidewall side in a transparent cover fold flat closed state, and said transparent cover including a semi-rigid border forming a perimeter around said transparent cover, wherein said semi-rigid border is disposed on said transparent cover on a side opposite of said transparent cover smooth side, wherein operationally said semi-rigid border facilitates easier hand grasping of said transparent cover and helps said light transmitting transparent cover remain substantially planar in shape.

2. An articulated light transmitting transparent cover apparatus according to claim 1 further comprising a removably engageable flexible clip that is disposed therethrough said surrounding sidewall, wherein said flexible clip projects over a portion of said base being operational to engage a portion of the article outer periphery to help retain the article to said article holder including said base and said surrounding sidewall.

3. An articulated light transmitting transparent cover apparatus according to claim 2 wherein said flexible clip further includes an expanded portion that is positioned opposite of said flexible clip projecting over said portion of said base all in relation to said surrounding sidewall, wherein operationally said expanded portion helps to retain said flexible clip within said surrounding sidewall.

4. An articulated light transmitting transparent cover apparatus according to claim 1 further comprising a removably engageable flexible clip that is disposed therethrough said first or second flexible hinge, wherein said flexible clip projects over a portion of said base being operational to engage a portion of the article outer periphery to help retain the article to said article holder including said base and said surrounding sidewall.

5. An articulated light transmitting transparent cover apparatus according to claim 4 wherein said flexible clip further includes an expanded portion that is positioned opposite of said clip projecting over said portion of said base all in relation to said first or second flexible hinge, wherein operationally said expanded portion helps to retain said flexible clip within said first or second flexible hinge.

6. An articulated light transmitting transparent cover apparatus according to claim 1 further comprising a connector structure portion that is positioned adjacent to said base opposite of said surrounding sidewall extension from said base, wherein said connector structure is disposed between said first flexible hinge and said second flexible hinge, said connector structure provides a one-piece continuous outer surface as between said opaque cover, said first flexible hinge, said connector structure, said second flexible hinge, and said light transmitting transparent cover for said articulated light transmitting cover apparatus for easier hand grasping and clothing pocket insertion and removal.

7. An articulated light transmitting transparent cover apparatus according to claim 1 wherein said semi-rigid border is sized and configured to create a reduced transparent area of said transparent cover to substantially match a display area of the article display to operationally facilitate a display light of the article to be substantially only directed therethrough said transparent cover reduced transparent area within said semi-rigid border.

* * * * *